US011667136B2

(12) United States Patent
Herrmann et al.

(10) Patent No.: US 11,667,136 B2
(45) Date of Patent: Jun. 6, 2023

(54) AIRFLOW CONTROL VIA PASSIVELY-REGULATED VACUUM PLENUM OF A PRINTING SYSTEM, AND RELATED DEVICES, SYSTEMS, AND METHODS

(71) Applicant: XEROX CORPORATION, Norwalk, CT (US)

(72) Inventors: Douglas K. Herrmann, Webster, NY (US); Jason M. LeFevre, Penfield, NY (US); Chu-Heng Liu, Penfield, NY (US); Paul J. McConville, Webster, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 107 days.

(21) Appl. No.: 17/218,873

(22) Filed: Mar. 31, 2021

(65) Prior Publication Data

US 2022/0314652 A1 Oct. 6, 2022

(51) Int. Cl.
*B41J 11/00* (2006.01)

(52) U.S. Cl.
CPC ..... *B41J 11/0085* (2013.01); *B41J 11/007* (2013.01)

(58) Field of Classification Search
CPC ..... B41J 11/0085; B41J 11/007
See application file for complete search history.

(56) References Cited

U.S. PATENT DOCUMENTS

| | | | | |
|---|---|---|---|---|
| 6,254,090 | B1 * | 7/2001 | Rhodes | G03G 15/6597 271/96 |
| 8,388,246 | B2 | 3/2013 | Spence et al. | |
| 9,944,094 | B1 | 4/2018 | Herrmann et al. | |
| 10,688,778 | B2 | 6/2020 | Fromm et al. | |
| 2020/0361225 | A1 * | 11/2020 | Escudero Gonzalez | B41J 11/06 |

FOREIGN PATENT DOCUMENTS

| | | | | |
|---|---|---|---|---|
| AU | 2014259492 | A1 * | 11/2014 | B41J 11/001 |
| EP | 1 319 510 | B1 | 9/2009 | |
| GB | 2 374 834 | A | 10/2002 | |
| JP | 3748782 | B2 * | 2/2006 | B41J 11/007 |

* cited by examiner

*Primary Examiner* — Sharon Polk
(74) *Attorney, Agent, or Firm* — Jones Robb, PLLC

(57) ABSTRACT

A printing system comprises a printhead to eject a print fluid to a deposition region. Print media are held by vacuum suction against a movable support surface, which moves over a vacuum platen to transport the print media through the deposition region. The vacuum platen has platen holes through which the vacuum suction is communicated. Multiple vacuum plenums are provided to supply the vacuum suction to different groups of the platen holes. A first vacuum plenum is fluidically coupled to a first group of the platen holes located at least partially in the deposition region, and to a second group of platen holes located upstream of the first group. A second vacuum plenum is fluidically coupled to a third group of the platen holes comprising at least some platen holes located between the first and second groups of platen holes.

18 Claims, 14 Drawing Sheets

AIRFLOW CONTROL VIA PASSIVELY-REGULATED VACUUM PLENUM OF A PRINTING SYSTEM, AND RELATED DEVICES, SYSTEMS, AND METHODS

FIELD

Aspects of this disclosure relate generally to inkjet printing, and more specifically to inkjet printing systems having a media transport assembly utilizing vacuum suction to hold and transport print media. Related devices, systems, and methods also are disclosed.

INTRODUCTION

In some applications, inkjet printing systems use an ink deposition assembly with one or more printheads, and a media transport assembly to move print media (e.g., a substrate such as sheets of paper, envelopes, or other substrate suitable for being printed with ink) through an ink deposition region of the ink deposition assembly (e.g., a region under the printheads). The inkjet printing system forms printed images on the print media by ejecting ink from the printheads onto the media as the media pass through the deposition region. In some inkjet printing systems, the media transport assembly utilizes vacuum suction to assist in holding the print media against a movable support surface (e.g., conveyor belt, rotating drum, etc.) of the transport device. Vacuum suction to hold the print media against the support surface can be achieved using a vacuum source (e.g., fans) and a vacuum plenum fluidically coupling the vacuum source to a side of the movable support surface opposite from the side that supports the print medium. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport assembly utilizing vacuum suction may allow print media to be securely held in place without slippage while being transported through the ink deposition region under the ink deposition assembly, thereby helping to ensure correct locating of the print media relative to the printheads and thus more accurate printed images. The vacuum suction may also allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include media transport assemblies utilizing vacuum suction is unintended blurring of images resulting from air currents induced by the vacuum suction. In some systems, such blurring may occur in portions of the printed image that are near the edges of the print media, particularly those portions that are near the lead edge or trail edge in the transport direction (sometimes referred to as process direction) of the print media. During a print job, the print media are spaced apart from one another on the movable support surface as they are transported through the deposition region of the ink deposition assembly, and therefore parts of the movable support surface between adjacent print media are not covered by any print media. This region between adjacent print media is referred to herein as the inter-media zone. Thus, adjacent to both the lead edge and the trail edge of each print medium in the inter-media zone there are uncovered holes in the movable support surface. Because these holes are uncovered, the vacuum of the vacuum plenum induces air to flow through those uncovered holes. This airflow may deflect ink droplets as they are traveling from a printhead to the substrate, and thus cause blurring of the image.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure, a printing system comprises an ink deposition assembly and a media transport assembly. The ink deposition assembly comprises a printhead arranged to eject a print fluid to a deposition region of the ink deposition assembly. The media transport assembly comprises a vacuum assembly and a movable support surface. The vacuum assembly comprises a vacuum platen comprising a plurality of platen holes; a first vacuum source and a first vacuum plenum fluidically coupled to the first vacuum source; and a second vacuum source and a second vacuum plenum fluidically coupled to the second vacuum source. The media transport assembly is configured to hold a print medium against the movable support surface by vacuum suction communicated from the vacuum sources to the movable support surface via the first and second vacuum plenums and the platen holes, and transport the print medium through the deposition region. The first vacuum plenum is fluidically coupled to a first group of the platen holes and to a second group of the platen holes, the first group of platen holes being located at least partially in the deposition region and the second group of platen holes being located upstream, relative to a direction of transport of the print medium, of the first group. The second vacuum plenum is fluidically coupled to a third group of the platen holes, the third group comprising at least some platen holes located between the first and second groups of platen holes.

In accordance with at least one embodiment of the present disclosure, a method comprises loading print media onto a movable support surface of a media transport assembly of a printing system; communicating vacuum suction through a first vacuum plenum to a first group of platen holes of a vacuum platen of the media transport assembly and to a second group of platen holes of the vacuum platen, the first group being located at least in part under a printhead of the printing system and thee second group being located upstream of the first group; communicating vacuum suction through a second vacuum plenum to a third group of platen holes of the vacuum platen, the third group being located at least in part between the first and second groups; holding the print media against the movable support surface via the vacuum suction; transporting the print media in a process direction through a deposition region of a printhead of the printing system by moving the movable support surface relative to the vacuum plenum; and ejecting print fluid from the printhead to deposit the print fluid to the print media in the deposition region.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings.

DETAILED DESCRIPTION

In the Figures and the description herein, numerical indexes such as "_1", "_2", etc. are appended to the end of the reference numbers of some components. When there are multiple similar components and it is desired to refer to a specific one of those components, the same base reference number is used and different indexes are appended to it to distinguish individual components. However, when the components are being referred to generally or collectively without a need to distinguish between specific ones, the index may be omitted from the base reference number. Thus, as one example, a print medium 5 may be labeled and referred to as a first print medium 5_1 when it is desired to identify a specific one of the print media 5, as in FIG. 1A, but it may also be labeled and referred to as simply a print medium 5 in other cases in which it is not desired to distinguish between multiple print media 5.

Figure 1A:
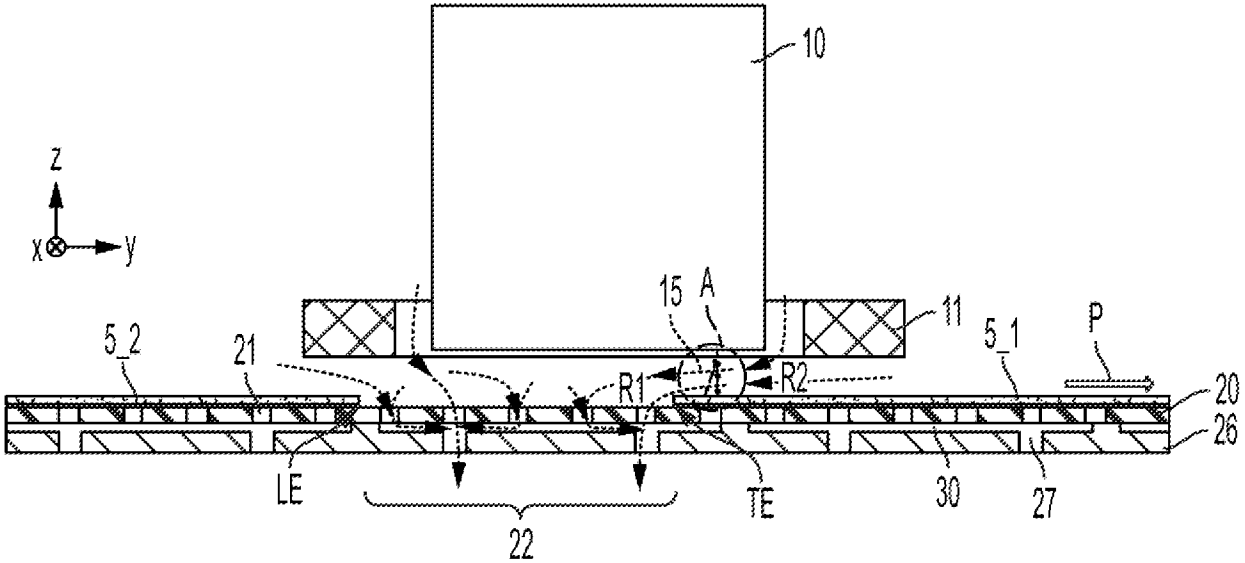
FIG. 1A RELATED ART
FIGS. 1A-1I schematically illustrate air flow patterns relative to a printhead assembly, transport device, and print media during differing stages of print media transport through an ink deposition region of a conventional inkjet printing system, and resulting blur effects in the printed media product.
Figure 1B:
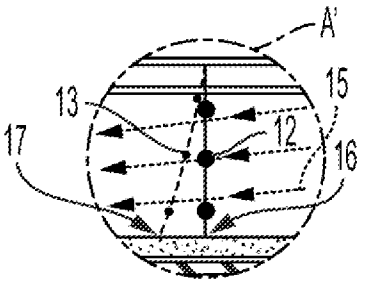
Figure 1C:
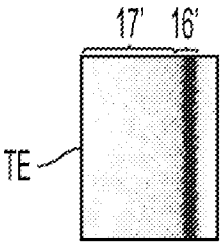
Figure 1D:
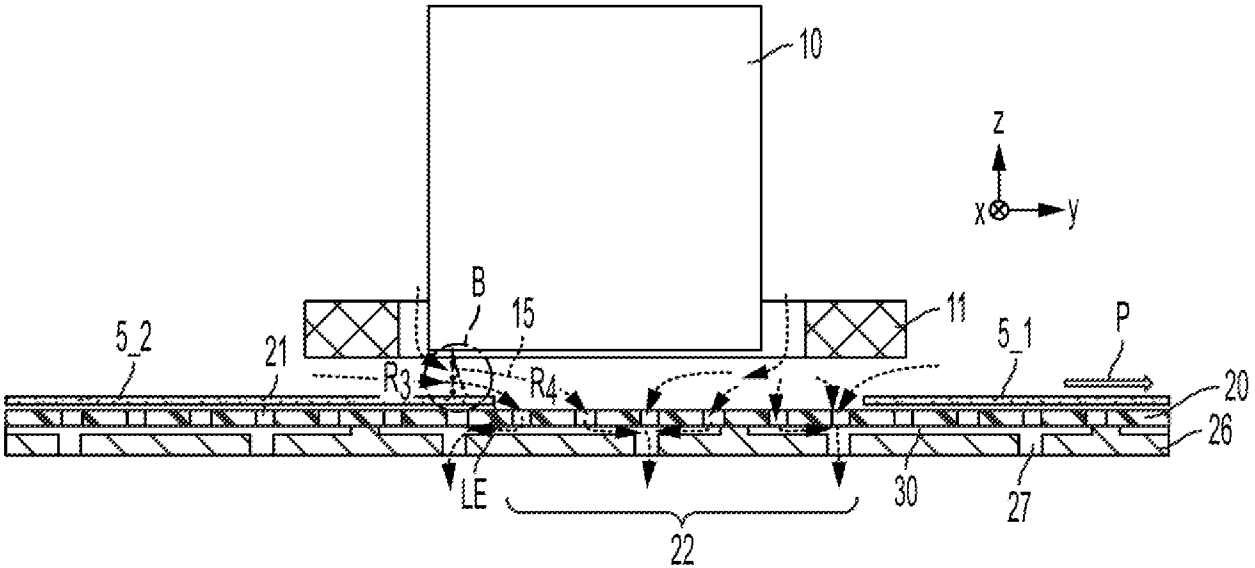
FIG. 1D RELATED ART
Figure 1F:
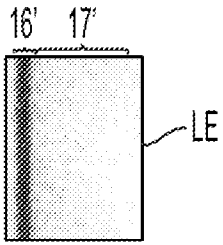
Figure 1E:
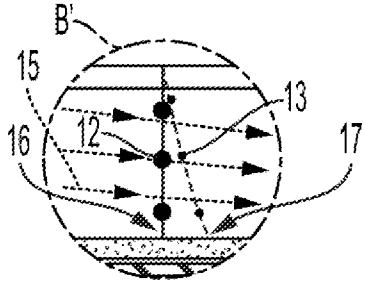
Figure 1G:
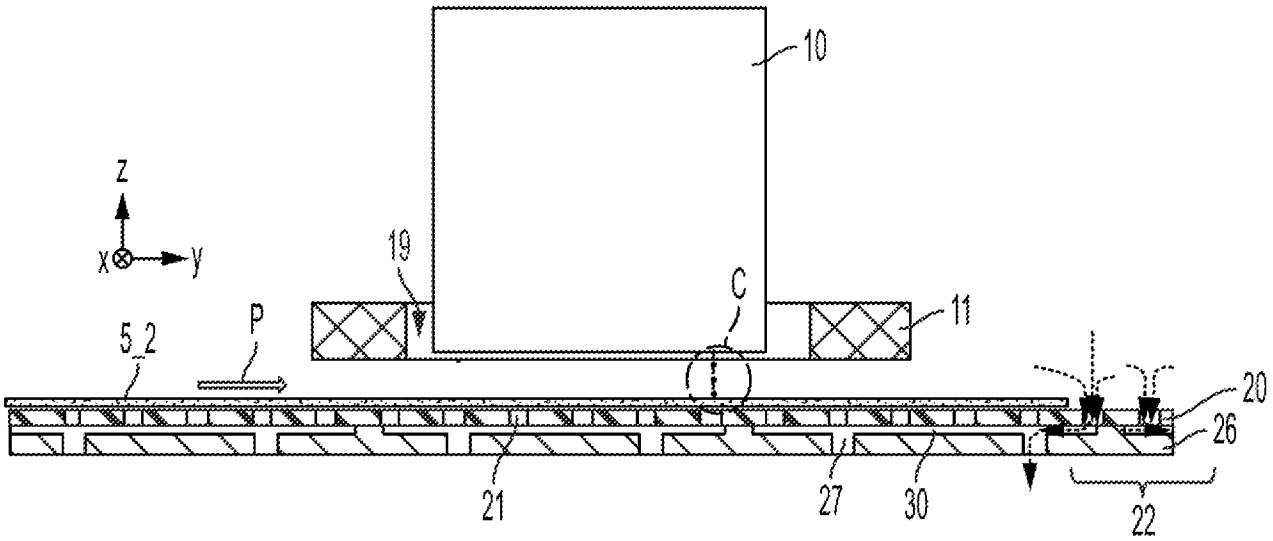
FIG. 1G RELATED ART
Figure 1I:
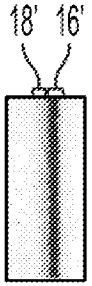
Figure 1H:
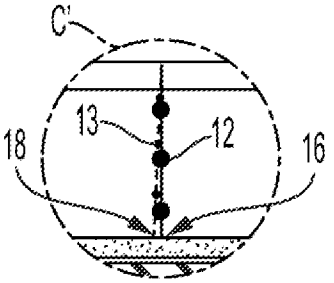

As described above, when an inter-media zone is near or under a printhead, the uncovered holes in the inter-media zone can create crossflows that can blow ink droplets ejected from a printhead off course and cause image blur. Similarly, uncovered holes along an inboard or outboard side of the print media can also create crossflows that case image blur. To better illustrate some of the phenomena occurring giving rise to the blurring issues, reference is made to FIGS. 1A-1I. FIGS. 1A, 1D, and 1G illustrate schematically a printhead 10 printing on a print medium 5 near a trail edge TE, a lead edge LE, and a middle, respectively, of the print medium 5. FIGS. 1A, 1D, and 1G are cross-sections taken through one of the printheads 10 along a process direction (y-axis direction in the figures). FIGS. 1B, 1E, and 1H illustrate enlarged views of the regions A, B, and C, of FIGS. 1A, 1D, and 1G, respectively. FIGS. 1C, 1F, and 1I illustrate enlarged pictures of printed images, the printed images comprising lines printed near the trail edge TE, lead edge LE, and middle portion, respectively, of a sheet of paper.

As shown in FIGS. 1A, 1D, and 1G, the inkjet printing system comprises one or more printheads 10 to eject ink to print media 5 (e.g., print medium 5_1 and 5_2) through printhead openings 19 in a carrier plate 11, and a movable support surface 20 that transports the print media 5 in a process direction P, which corresponds to a positive y-axis direction in the Figures. The movable support surface 20 is movable (e.g., slides) along a top of a vacuum platen 26, and a vacuum environment is provided on a bottom side of the platen 26. The vacuum platen 26 has platen holes 27 coupled to platen channels 30, with the platen holes 27 opening to the vacuum environment below the platen 26 and the platen channels 30 opening to the region above the platen 26. Thus, the platen holes 27 and platen channels 30 communicate vacuum the bottom side of the movable support surface. The platen channels 30 extend in the process direction P, and each may be coupled to one or multiple platen holes 27. The movable support surface 20 has holes 21, with each hole 21 periodically aligning with platen channels 30 as the movable support surface 20 moves. Thus, when one of the holes 21 is located over a channel 30, the hole 21 communicates the vacuum suction from the channel 30 to the region above the movable support surface 20. In regions where the print media 5 cover the holes 21, the vacuum suction communicated through the holes 21 (via platen holes 27 and platen channels 30) generates a force that holds the print media 5 against the movable support surface 20. However, little or no air flows through these covered holes 21 since they are blocked by the print media 5. On the other hand, as shown in FIGS. 1A, 1D, and 1G, in the inter-media zone 22 between adjacent print media (e.g., between print media 5_1, 5_2), the holes 21 are not covered by any print media and therefore the vacuum suction pulls air to flow down through the uncovered holes 21. This creates airflows, indicated by the dashed arrows in FIGS. 1A, 1D, and 1G, which flow from regions around the printhead 10 towards the uncovered holes 21 and 27 in the inter-media zone 22. As shown in FIGS. 1A and 1D, when the inter-media zone 22 is near or under a printhead 10, some of the airflows induced by the inter-media zone 22 pass under the printhead 10.

In FIG. 1A, the print medium 5_1 is being printed on near its trail edge TE, and therefore the region where ink is currently being ejected ("ink-ejection region") (e.g., region A in FIG. 1A) is located downstream of the inter-media zone 22 (upstream and downstream being defined with respect to the process direction P, which is the direction of transport of the print media by the movable support surface 20). Accordingly, some of the air being sucked towards the inter-media zone 22 will flow upstream through the ink-ejection region A. More specifically, the vacuum suction from the inter-media zone 22 lowers the pressure in the region immediately above the inter-media zone 22, e.g., region $R_1$ in FIG. 1A, while the region downstream of the printhead 10, e.g., region $R_2$ in FIG. 1A, remains at a higher pressure. This pressure gradient causes air to flow in an upstream direction from the region $R_2$ to the region $R_1$, with the airflows crossing through the ink-ejection region (e.g., region A in FIG. 1A) which is between the regions $R_1$ and $R_2$. Some of this air may be pulled from the gap 9*d* between the downstream face of the printhead 10 and a rim of the opening 19 through which the printhead 10 ejects ink. Airflows such as these, which cross through the ink-ejection region, are referred to herein as crossflows 15. In FIG. 1A, the crossflows 15 flow upstream, but in other situations the crossflows 15 may flow in different directions.

As shown in the enlarged view A' in FIG. 1B, which comprises an enlarged view of the region A, as ink is ejected from the printhead 10 towards the medium 5, main ink droplets 12 and satellite ink droplets 13 are formed. The satellite droplets 13 are much smaller than the main droplets 12 and have less mass and momentum, and thus the upstream crossflows 15 tend to affect the satellite droplets 13 more than the main droplets 12. Thus, while the main droplets 12 may land on the print medium 5 near their intended deposition location 16 regardless of the crossflows 15, the crossflows 15 may push the satellite droplets 13 away from the intended trajectory so that they land at an unintended location 17 on the medium 5, the unintended location 17 being displaced from the intended location 16. This can be seen in an actual printed image in FIG. 1C, in which the denser/darker line-shaped portion is formed by the main droplets which were deposited predominantly at their intended locations 16, whereas the smaller dots dispersed away from the line are formed by satellite droplets which were blown away from the intended locations 16 to land in unintended locations 17, resulting in a blurred or smudged appearance for the printed line. Notably, the blurring in FIG. 1C is asymmetrically biased towards the trail edge TE of the paper shown, which would be due to the crossflows 15 near the trail edge TE blowing primarily in an upstream direction depicted in FIGS. 1A and 1B. The inter-media zone 22 may also induce other airflows flowing in other directions, such as downstream airflows from an upstream side of the printhead 10, but these other airflows do not pass through the region where ink is currently being ejected in the illustrated scenario and thus do not contribute to image blur. Only those airflows that cross through the ink ejection region are referred to herein as crossflows.

FIGS. 1D-1F illustrate another example of such blurring occurring, but this time near the lead edge LE of the print medium 5_2. The cause of blurring near the lead edge LE as shown in FIGS. 1C and 1D is similar to that described above in relation to the trail edge TE, except that in the case of printing near the lead edge LE the ink-ejection region is now located upstream of the inter-media zone 22. As a result, the crossflows 15 that are crossing through the ink-ejection region now originate from the upstream side of the printhead 10, e.g., from region $R_3$, and flow downstream to region $R_4$ where the uncovered holes of the inter-media zone 22 adjacent the lead edge LE are. For example, air may be pulled from the gap 9*u* between the upstream face of the printhead 10 and the rim of the opening 19 of the carrier plate 11. Thus, as shown in the enlarged view B' of FIG. 1E, which comprises an enlarged view of the ink ejection region B, in the case of printing near the lead edge LE, the satellite droplets 13 are blown downstream towards the lead edge LE of the print medium 5_2 (positive y-axis direction). As shown in FIG. 1F, such a phenomenon results in asymmetric blurring that is biased towards the lead edge LE, in which satellite droplets get deposited at undesired locations 17 relative to the intended location 16.

In contrast, as shown in FIG. 1G and the enlarged view C' in FIG. 1H which corresponds to an enlarged view of ink ejection region C, when a print medium (e.g., print medium 5_2) is being printed on in a middle portion, farther from the trail and lead edges TE, LE, there may be little or no crossflows 15 because the inter-media zone 22 and the uncovered region 24 are too distant from the printhead 10 and the ink-ejection region D to induce much airflow near the ink-ejection region D. Because the crossflows 15 are absent or weak farther away from the edges of the print medium 5, the satellite droplets 13 in this region are not as likely to be blown off course. Thus, as shown in FIGS. 1H and 1I, when printing farther from the edges of the print medium 5_2, the satellite droplets land at locations 18 that are much closer to the intended locations 16 resulting in much less image blurring. The deposition locations 18 of the satellite droplets may still vary somewhat from the intended locations 16, due to other factors affecting the satellite droplets, but the deviation is smaller than it would be near the lead or trail edges, thus not resulting in as noticeable blurring.

Embodiments disclosed herein may, among other things, inhibit some of the crossflows so as to reduce the image blur that may result from such crossflows. By inhibiting crossflows, the droplets ejected from a printhead (including, e.g., the satellite droplets) are more likely to land closer to or at their intended deposition locations, and therefore the amount of blur can be reduced. In accordance with various embodiments, a media transport assembly utilizes a passively-regulated vacuum plenum dedicated to provide the suction force that is used in a region of the vacuum platen under the printhead(s) (i.e., in the deposition region), as well as for a control region of the vacuum platen, as described further below. The passively-regulated vacuum plenum is used in conjunction with another vacuum plenum that is used to provide the remainder of the suction force to other regions of the vacuum platen not addressed by the passively-regulated vacuum plenum. In this way, different vacuum plenums can be used to provide vacuum suction to different regions of the vacuum platen and to corresponding different groups of platen holes in each region so as to achieve flow control a passive airflow control regulation in the region of the platen associated with inducing undesirable crossflows.

In one embodiment, the media transport assembly comprises two vacuum plenums, with a first vacuum plenum configured to provide vacuum suction to a first group of platen holes located in the deposition region under the printhead(s) of the printing system (hereinafter the "printhead group") and to a second group of platen holes that are located within a region that is a predetermined distance upstream of the printhead group (hereinafter the "control group"). A second vacuum plenum is configured to provide vacuum suction to the remaining platen holes in the vacuum platen (hereinafter the "remaining group"). The printhead group and the control group of platen holes, together with the first vacuum plenum, are configured so as to reduce the flow rate of airflow through the platen holes of the printhead group at timings when an inter-media zone is located above the printhead group of platen holes. Such airflows through the printhead group of platen holes when the inter-media zone is located above the printhead group of platen holes tend to induce crossflows (because the printhead group of platen holes is located near the printhead(s)) and therefore reducing the rate of airflow through the printhead group of platen holes when the inter-media zone is present can help to reduce the strength of the crossflows.

In some embodiments, the above-described reduction in the rate of airflow through the printhead group of platen holes when an inter-media zone is above the printhead group is achieved as a result of the control group of platen holes also being uncovered (due to a subsequent inter-media zone) while the first inter-media zone is passing over the printhead group. The uncovering of the control group of platen holes relieves some of the suction from the first vacuum plenum, thus reducing the flow rate through the printhead group of platen holes. By uncovering the additional holes of the control group of platen holes, the vacuum suction from the vacuum plenum can be distributed among a larger number of platen holes, rather than being concentrated on just the platen holes of the printhead group, and therefore the platen holes of the printhead group experiences less suction than they would if just the printhead group were uncovered. In other words, air flowing through the control group of platen holes tends to offset some of the low pressure in the vacuum plenum, thus raising the pressure in the vacuum plenum, which decreases the pressure differential across the printhead group of platen holes and hence reduces the strength of suction through the printhead group of platen holes. Thus, the airflow rate through the printhead group when an inter-media zone is located above the printhead group depends (at least in part) on whether the control group is covered or uncovered at that timing.

In various embodiments, the control group is positioned relative to the printhead group such that the control group is automatically uncovered at timings that correlate to when an inter-media zone is located above the printhead group (i.e., in the deposition region). In other words, the control group of platen holes is positioned at a region of the vacuum platen that is upstream of the control group by a predetermined distance approximately equal to a length of a given print medium. In this way, during a printing operation in which the movable support surface of the media transport assembly is loaded with print media spaced by inter-media zones, when one inter-media zone is located above the printhead group in the deposition region another inter-media zone (upstream of the one inter-media zone) is located above the control group of platen holes. This arrangement allows the airflow rate through the printhead group to be passively controlled at the timings when the inter-media zone is located above the printhead group by the movement of another inter-media zone over the control group. Thus, airflow control to address crossflows and reduce blurring effects can be achieved without the use of actively controlling the airflow through the air supply or valving controls. Accordingly, because the pressure in the first vacuum plenum is passively controlled via the timing of inter-media zones over different groups of platen holes coupled together by the plenum, a "passively-regulating" effect of the first vacuum plenum results.

In some embodiments, the number and location of platen holes in the control group of platen holes that allow airflow to pass through (or that are open to communicate the suction force therethrough) can be selectively adjustable by providing a baffle mechanism that allows blocking and unblocking of the platen holes. In one embodiment, to achieve such selective flow communication through the platen holes in the control group, a movable baffle that has an aperture is provided in the first vacuum plenum. The baffle selectively covers or uncovers a subset of the platen holes in the control group so as to divide them into "active" platen holes, which are located in the aperture and are in fluidic communication with the plenum through the aperture to allow the suction force communication therethrough, and "inactive" platen holes, which are blocked by the baffle and not coupled to the plenum. The baffle can be movable in the process direction, thus changing which platen holes are located in the aperture. Thus, moving the baffle in the process direction changes which platen holes of the control group are active. This can allow the active platen holes of the control group to be positioned based on the size of the print media and the inter-media zones such that they are covered/uncovered at the correct timings despite variation in print media size. The baffle may be moved into place at the start of a print job and may remain in place until a new job with a different size of print media is started. The baffle may be moved manually (e.g., before a print run based on the known size of the print media and inter-media zones) or automatically by the printing system (e.g., via an actuator controlled by a controller of the printing system).

Figure 2:
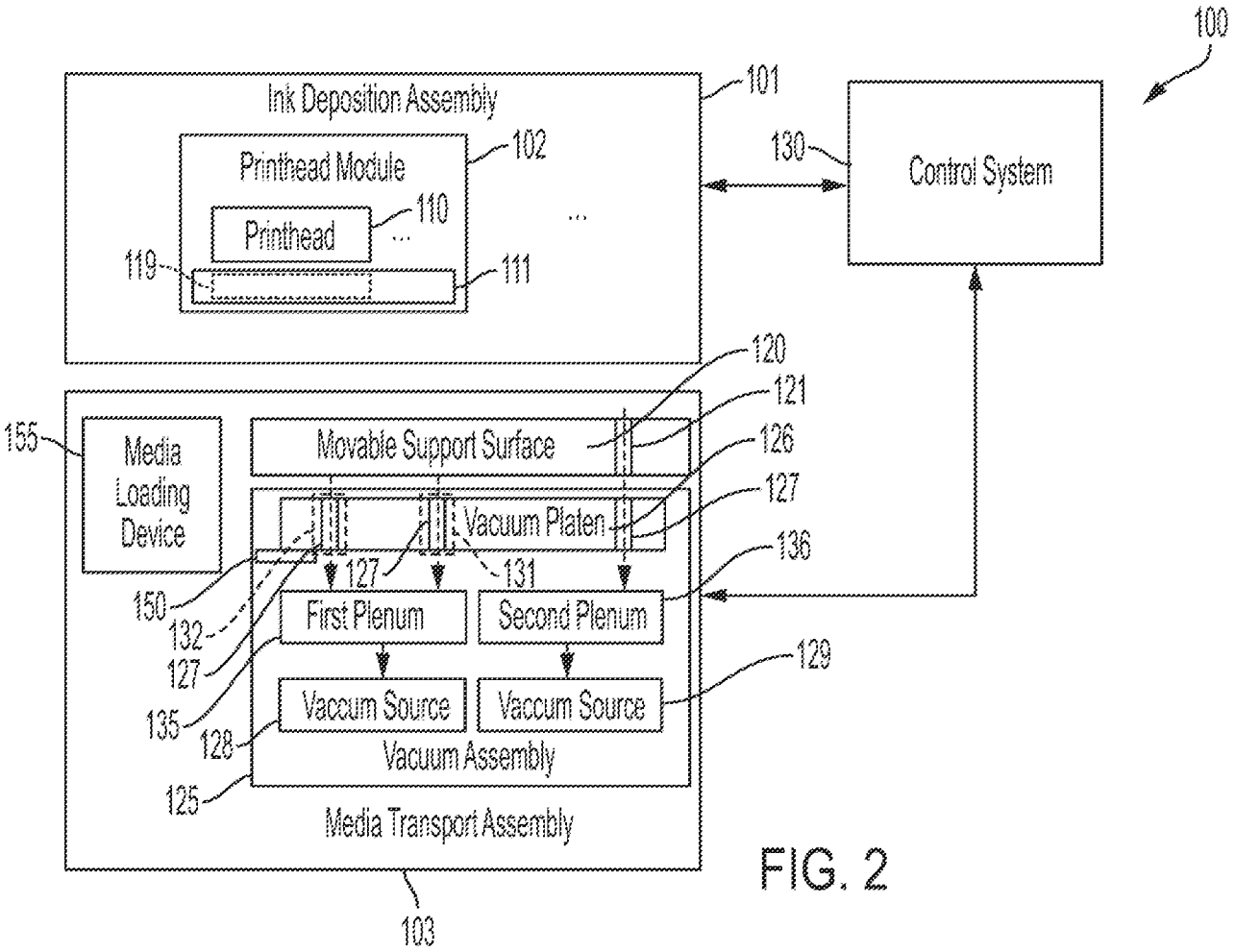
FIG. 2 is a block diagram illustrating components of an embodiment of an inkjet printing system including an air flow control system.

Turning now to FIG. 2, an embodiment of a printing system will be described in greater detail. FIG. 2 is a block diagram schematically illustrates a printing system 100 utilizing the above-described airflow control system. The printing system 100 comprises an ink deposition assembly 101 to deposit ink on print media, a media transport assembly 103 to transport print media through the ink deposition assembly 101, and a control system 130 to control operations of the printing system 100.

The ink deposition assembly 101 comprises one or more printhead modules 102. One printhead module 102 is illustrated in FIG. 2 for simplicity, but any number of printhead modules 102 may be included in the ink deposition assembly 101. In some embodiments, each printhead module 102 may correspond to a specific ink color, such as cyan, magenta, yellow, and black. Each printhead module 102 comprises one or more printheads 110 configured to eject print fluid, such as ink, onto the print media to form an image. In FIG. 2, one printhead 110 is illustrated in the printhead module 102 for simplicity, but any number of printheads 110 may be included per printhead module 102. The printhead modules 102 may comprise one or more walls, including a bottom wall which may be referred to herein as a carrier plate 111. The carrier plate 111 comprises printhead openings 119, and the printheads 110 are arranged to eject their ink through the printhead openings 119. In some embodiments, the carrier plate 111 supports the printheads 110. In other embodiments, the printheads 110 are supported by other structures. The printhead modules 102 may also include additional structures and devices to support and facilitate operation of the printheads 110, such as, ink supply lines, ink reservoirs, electrical connections, and so on, as known in the art.

As shown in FIG. 2, the media transport assembly 103 comprises a movable support surface 120, a vacuum assembly 125, and a media loading device 155. The movable support surface 120 transports the print media through a deposition region of the ink deposition assembly 101. The vacuum assembly 125 supplies vacuum suction to one side of the movable support surface 120 (e.g., a bottom side), and print media is supported on an opposite side of the movable support surface 120 (e.g., a top side). Holes 121 through the movable support surface 120 communicate the vacuum suction through the surface 120, such that the vacuum suction holds down the print media against the surface 120. The media loading device 155 loads the print media onto the movable support surface 120 and registers the print media.

The movable support surface 120 is movable relative to the ink deposition assembly 101, and thus the print media held against the movable support surface 120 is transported relative to the ink deposition assembly 101 as the movable support surface 120 moves. Specifically, the movable support surface 120 transports the print media in a process direction through a deposition region of the ink deposition assembly 101, the deposition region being a region in which print fluid (e.g., ink) is ejected onto the print media, such as a region under the printhead(s) 110. The movable support surface 120 can comprise any structure capable of being driven to move relative to the ink deposition assembly 101 and which has holes 121 to allow the vacuum suction to hold down the print media, such as a belt, a drum, etc.

The vacuum assembly 125 comprises a vacuum platen 126, a first vacuum plenum 135, a second vacuum plenum 136, and one or more vacuum sources 128. The vacuum platen 126 forms an upper wall of the vacuum assembly 125 and supports the movable support surface 120. Each of the first and second vacuum plenums 135 and 136 comprises baffles, walls, or any other structures arranged to enclose or define an environment in which a vacuum state (e.g., low pressure state) is maintained by a corresponding vacuum source 128, 129. Each plenum 135, 136 fluidically couples its corresponding vacuum source 128, 129 to the movable support surface 120 via platen holes 127 in the vacuum platen 126 and together with the vacuum platen 126 define a vacuum chamber for the vacuum environment. Thus, the movable support surface 120 is exposed to the vacuum state within the vacuum plenums 135, 136 through the vacuum platen 126. The vacuum source 128, 129 may be any device configured to remove air from the plenum 135, 136 to create the low-pressure state in the plenum 135, 136 such as a fan, a pump, etc., as those of ordinary skill in the art would be familiar with.

The platen holes 127 are distributed across the vacuum platen 126 such that each of the holes 121 in the movable support surface 120 is alignable in the process direction with a corresponding collection of the platen holes 127, and thus as the movable support surface 120 moves relative to the vacuum platen 126, each respective hole 121 moves sequentially over each of the corresponding holes 127. When a hole 121 is located above a platen hole 127, the vacuum suction is communicated from the vacuum plenum 125 through the platen hole 127 and the hole 121 to the region above the given hole 121. If a print medium is located above a hole 121, then the vacuum suction communicated through that hole 121 generates a suction force on the print medium that pulls the print medium towards the movable support surface 120. If no print medium is located above the hole 121, then the vacuum suction induces air from above the movable support surface 120 to flow down through the hole 121 and the platen hole 127 with which it is aligned into the vacuum platen 126. In some embodiments, the platen holes 127 may include channels. In some embodiments, the platen holes 127 may comprise through holes. In some embodiments, the platen holes 127 may comprise both through holes and channels, e.g., a through hole portion on a bottom side of the platen 126, which opens to the vacuum plenum 135 or 136, and a channel portion on a top side, which opens to the movable support surface 120.

The first vacuum plenum 135 is fluidically coupled to a first group 131 of platen holes 127 (hereinafter "printhead group 131") and a second group 132 of platen holes 127 (hereinafter "control group 132"). The printhead group 131 is located near (e.g., under) one or more of the printheads 110. The control group 132 is located a predetermined distance upstream of the printhead group 131. The distance is such that, for a given size of print medium and a given spacing between print medium (inter-media zone), when an inter-media zone is located above the printhead group 131 another inter-media zone is located above the control group 132, as described above.

In some embodiments, the first vacuum plenum 135 also comprises a baffle mechanism 150, which can be moved in the process direction to change which platen holes 127 of the control group 132 are active (i.e., fluidically coupled to the first vacuum plenum 135). The baffle mechanism 150 may be moved to change the number, location, or both number and location of active platen holes 127 in the control group 132. In some embodiments, the baffle mechanism 150 has an aperture, such that those platen holes 127 of the control group 132 that are aligned with the aperture are active while the other platen holes 127 of the control group 132 are blocked. In some embodiments, the baffle mechanism 150 comprises shutter. In embodiments in which a baffle mechanism 150 is used, the baffle mechanism 150 may be moved based on the size of the selected print media for a print job, such that the active platen holes 127 of the control group 132 are located as described above. In some embodiments, the printing system 100 comprises an actuator to move the baffle, and a control system 130 (described below) may be configured to cause the actuator to move the baffle to a desired location based on the size of the print media selected for a print job.

In some embodiments, the platen holes 127 that are part of the printhead group 131 and control group 132 may be configured differently than the remainder of platen holes 127. For example, in one embodiment the platen holes 127 comprise channels, and the channels of the printhead and control groups 131, 132 may extend in the cross-process direction while the channels of the remaining platen holes 127 may extend in the process direction.

As noted above, the media loading device 155 loads the print media onto the movable support surface 120 and registers the print media relative to various registration datums, as those of ordinary skill in the art are familiar with. For example, as each print medium is loaded onto the movable support surface 120, and one edge of each print medium may be registered to (i.e., aligned with) a process-direction registration datum that extends in the process direction. Herein, whichever side of the media transport assembly 103 is closest to the process-direction registration datum is referred to as the outboard side of the media transport assembly 103 and the edge that is registered to this datum is referred to as the outboard edge, while the opposite side of the device is referred to as the inboard side and the opposite edge is referred to as the inboard edge. In practice, the registration datum could be located on either side of the media transport assembly 103, and thus the side of the media transport assembly 103 that is considered the outboard side will vary from system to system (or from time to time within the same system) depending on which side the print media happen to be registered to. In addition, the lead and/or trail edges of the print media may be registered to various cross-process datums along the movable support surface 120 as the print media are loaded thereon. Thus, by registering each print medium to the process-direction registration datum and one of the cross-process registration datums, a precise location and orientation of the print medium relative to the movable support surface 120 may be enforced, thus allowing for accurate printing of images on the print medium. Various media loading devices for loading print media onto a movable support surface and registering the print media relative to the movable support surface are known in the art and used in existing printing systems. Any existing media loading device, or any new media loading device, may be used as the media loading device 155. Because the structure and function of such media loading devices are well known in the art, further detailed description of such systems is omitted.

The control system 130 comprises processing circuitry to control operations of the printing system 100. The processing circuitry may include one or more electronic circuits configured with logic for performing the various operations described herein. The electronic circuits may be configured with logic to perform the operations by virtue of including dedicated hardware configured to perform various operations, by virtue of including software instructions executable by the circuitry to perform various operations, or any combination thereof. In examples in which the logic comprises software instructions, the electronic circuits of the processing circuitry include a memory device that stores the software and a processor comprising one or more processing devices capable of executing the instructions, such as, for example, a processor, a processor core, a central processing unit (CPU), a controller, a microcontroller, a system-on-chip (SoC), a digital signal processor (DSP), a graphics processing unit (GPU), etc. In examples in which the logic of the processing circuitry comprises dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and general-purpose processor with software.

Figure 3:
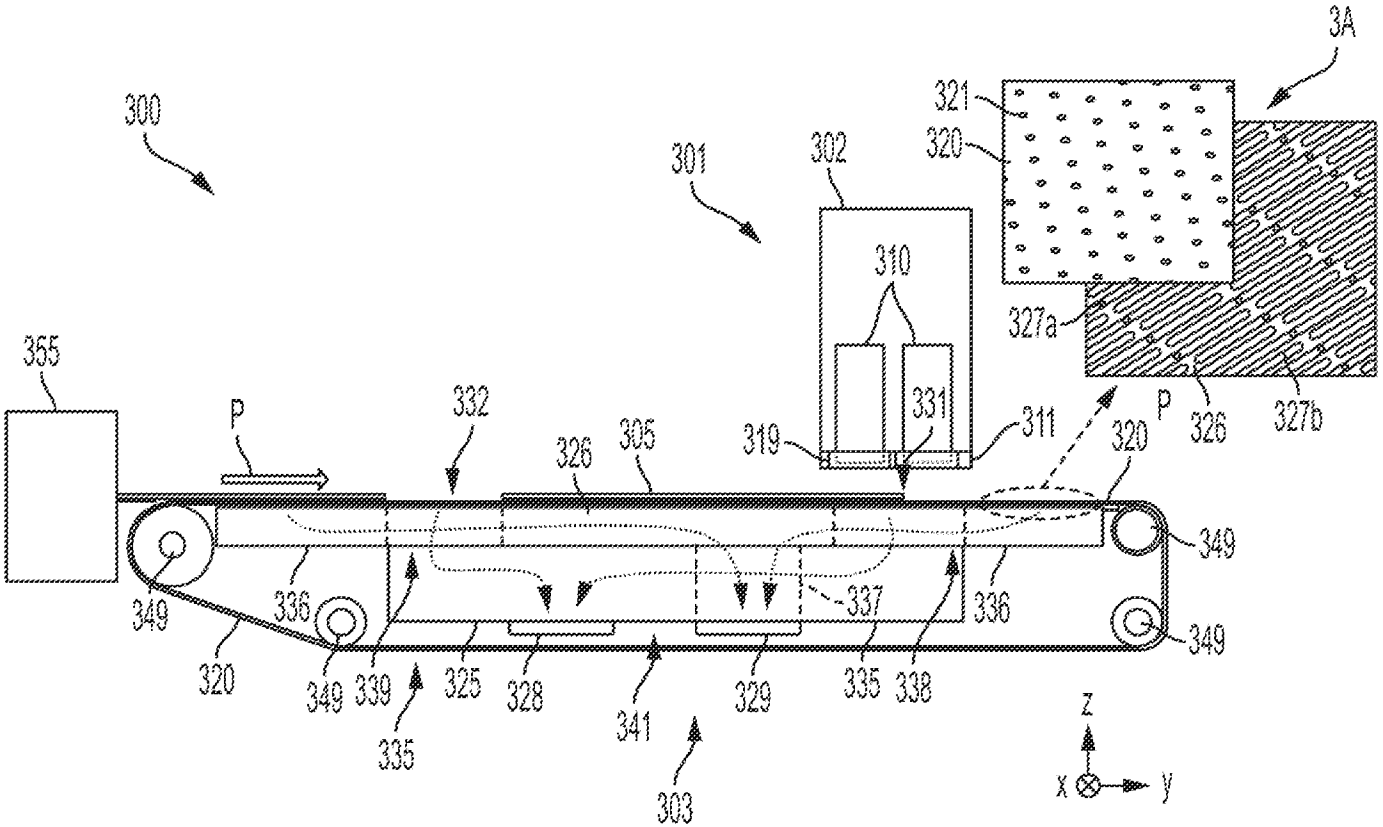
FIG. 3 is a schematic illustration of an ink deposition assembly and media transport assembly of one embodiment of an inkjet printing system.
Figure 4:
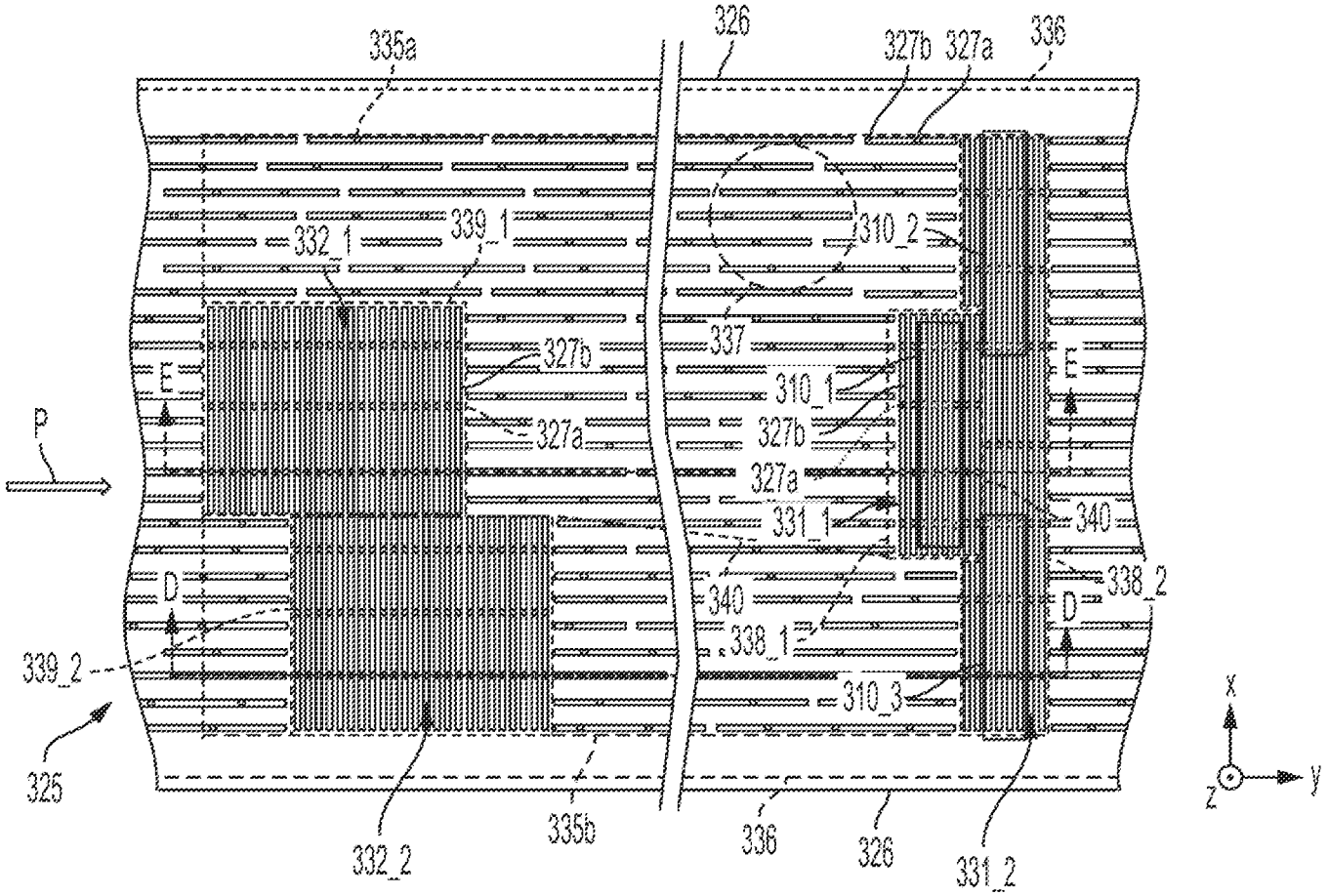
FIG. 4 is a plan view from above the inkjet printing system of FIG. 3.
Figure 5:
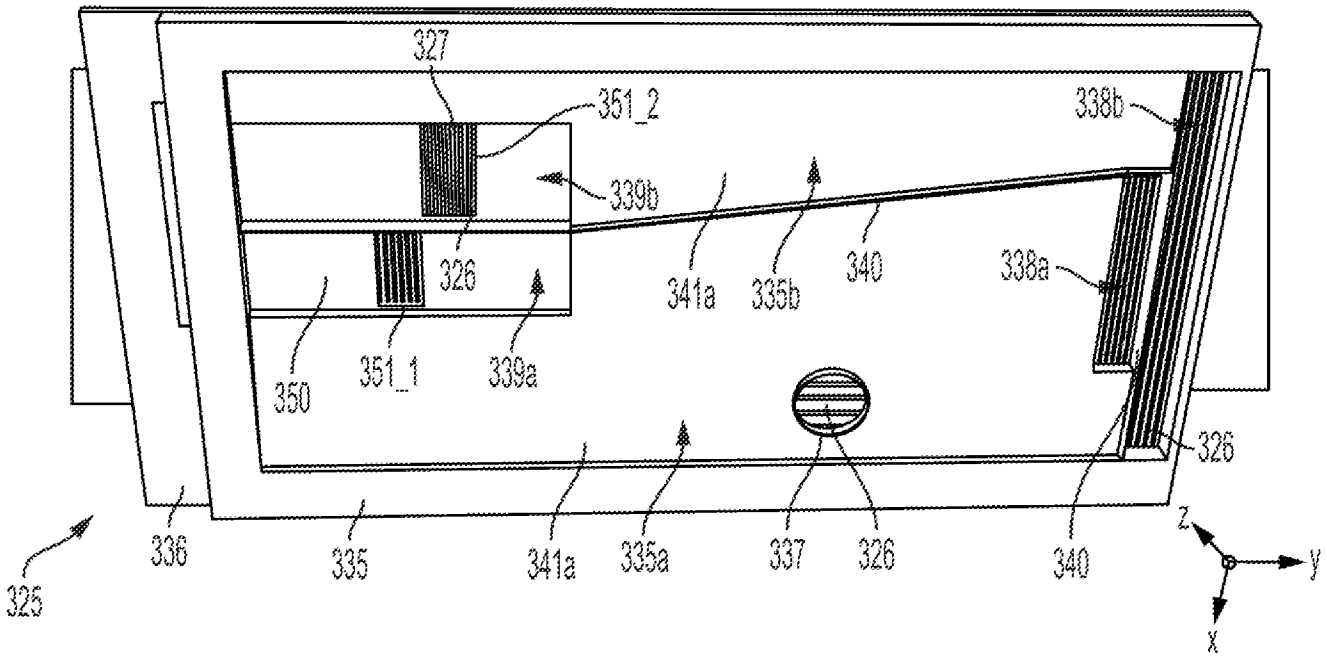
FIG. 5 is a perspective view of a vacuum assembly of the inkjet printing system of FIG. 3 from below the vacuum assembly.
Figure 6:
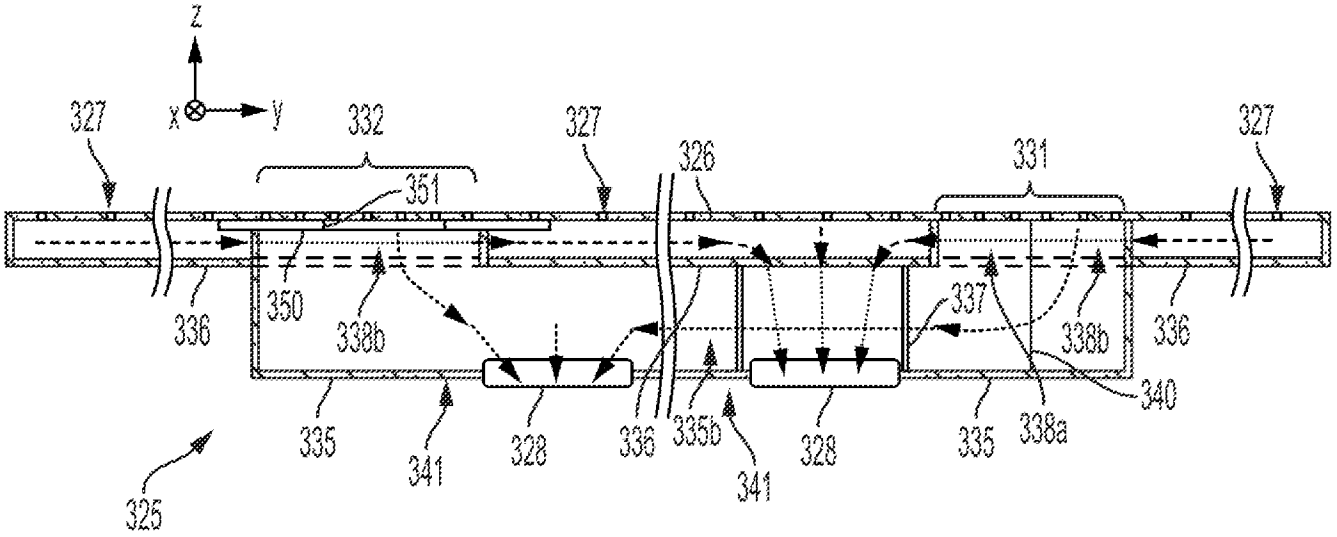
FIG. 6 is a cross-section of the vacuum assembly of the inkjet printing system of FIG. 3, with the cross-section taken along D in FIG. 4.

Turning now to FIGS. 3-7E, an embodiment of a printing system 300 will be described, which may be used as the printing system 100 described above with reference to FIG. 2. FIG. 3 is a schematic illustration of a portion of the printing system 300 from a side view. FIG. 4 is a plan view of a portion of a vacuum assembly 325 of a media transport assembly 303 of the printing system 300 from above a vacuum platen 326 of the vacuum assembly 325. FIG. 5 is a perspective view of the vacuum assembly 325 from a bottom side of the vacuum assembly 325 and with a bottom wall and vacuum sources removed. FIG. 6 is a cross-section of the vacuum assembly 325 taken along D in FIG. 4. FIGS. 7A-7E are cross-section views of the printing system 300 taken along E in FIG. 4. In FIGS. 3-7E, components that would otherwise be hidden from view are illustrated in dotted or dashed lines. In FIGS. 3-7E, airflows are indicated by dot-lined or dash-lined arrows, with dot-lined arrows indicating airflows passing through a portion of the system 300 that would be hidden in the depicted view and dash-lined arrows indicating airflows passing through portions of the system 300 that are visible in the depicted view.

As illustrated in FIG. 3, the printing system 300 comprises an ink deposition assembly 301 and a media transport assembly 303, which can be used as the ink deposition assembly 101 and media transport assembly 103, respectively, described above with reference to FIG. 2. The printing system 300 may also comprise additional components not illustrated in FIG. 3, such as a control system (e.g., similar to the control system 130).

In the printing system 300, the ink deposition assembly 301 comprises one or more printhead modules 302 (one is depicted in FIG. 3), with each printhead module 302 having multiple printheads 310. The printhead model(s) 302 are arranged in series along a process direction P above the media transport assembly 303, such that the print media 305 is transported sequentially beneath each of the printhead modules 302. The printheads 310 are arranged to eject print fluid (e.g., ink) through respectively corresponding printhead openings 319 in a corresponding carrier plate 311. In an embodiment (see FIG. 4), each printhead module 302 has three printheads 310 arranged to span a cross-process direction of the media transport assembly. The printheads 310 are arranged in an offset pattern with two printheads 310 being aligned within one another in the cross-process direction and the third printhead 310 being offset upstream or downstream from the other two printheads 310. In other embodiments of the printing system 300, different numbers and/or arrangements of printheads 310 and/or printhead modules 302 are used.

In the printing system 300, media transport assembly 303 comprises a flexible belt providing the movable support surface 320. As shown in FIG. 3, the movable support surface 320 is driven by rollers 349 to move along a looped path, with a portion of the path passing through the ink deposition region 323 of the ink deposition assembly 301. Additional rollers in lieu of or in addition to those illustrated may also be provided, such as one or more rollers to press the print media against the movable support surface 320 when being loaded onto the movable support surface 320, one or more rollers to engage an outward facing surface of the movable support surface 320, and so on as would be familiar to those of ordinary skill in the art. The path that the movable support surface 320 takes in FIG. 3 is non-limiting and other paths are contemplated as within the scope of the disclosure. The media transport assembly 303 also comprises a media loading device 355, which loads print media 305 onto the movable support surface 320 and registers the print media 305 relative to the movable support surface 320. The media loading device 355 is similar to and may be used as the media loading device 155 described above.

The movable support surface 320 comprises a number of holes 321 extending through the belt. The holes 321 are to communicate vacuum suction from below the belt (from the vacuum assembly 326, described further below) to the region above the belt to provide a vacuum suction force to hold the print media against the movable support surface 320. The holes 321 are arranged in a pattern across the movable support surface 320 so as to provide relatively even vacuum suction force to the print media and so as to accommodate various sizes of print media.

The vacuum assembly 325 may be used as the vacuum assembly 125 described above. The vacuum assembly 325 comprises a vacuum platen 326, a first vacuum plenum 335, a second vacuum plenum 336, and one or more vacuum sources 328. The vacuum platen 326 forms an upper wall of the vacuum assembly 325 and supports the movable support surface 320. Each of the first and second vacuum plenums 335 and 336 comprises baffles, walls, or any other structures arranged to enclose or define an environment in which a vacuum state (e.g., low pressure state) is maintained by a corresponding vacuum source 328, 329, with each plenum 335, 336 fluidically coupling its corresponding vacuum source 328, 329 to the movable support surface 320 via platen holes 327 in the vacuum platen 326. Thus, the movable support surface 320 is exposed to the vacuum state within the vacuum plenum 325 through the vacuum platen 326. The vacuum sources 328, 329 may be any device configured to remove air from the plenum 335, 336 to create the low-pressure state in the plenum 335, 336 such as a fan, a pump, etc. The first and second vacuum plenums 335 and 336 can be used as the first and second vacuum plenums 135 and 136, respectively, which were described above in relation to FIG. 2.

The vacuum platen 326 comprises a number of platen holes 327 to fluidically couple the interior of the vacuum plenums 335 and 336 to the region above the platen 326. The platen holes 327 may be used as the platen holes 127 described above. The platen holes 327 are distributed across the platen 326 such that holes 321 in the movable support surface 320 periodically align with the platen holes 327, as described above with respect to the platen holes 127. In the embodiment illustrated in FIGS. 3-7A, the platen holes 327 comprise a through-hole portion 327*a* which opens to a bottom side of the vacuum platen 326 and a channel portion 327*b* which opens to a top side of the vacuum platen 327, as seen in the expanded cutaway 3A of FIG. 3 and in FIG. 4. The channel portion 327*b* is elongated, forming a channel along the top surface of the platen 326. As shown in FIGS. 3 and 4, multiple through hole-portions 326*a* may share (i.e., be coupled to) the same channel portion 327*b*. In other embodiments of the printing system 300, the platen holes 327 can have other shapes than those illustrated in FIGS. 3 and 4. For example, the platen holes 327 can comprise through-holes (e.g., cylindrical through-holes) that extend all the way through the thickness dimension (z-direction) of the platen 326 without any channel portions, elongated channels (e.g., rectangular profile channels) that extend all the way through the thickness dimension (z-direction) of the platen 326 without through-hole portions, or any other shape or configuration that provides a passageway to communicate the vacuum suction from the vacuum plenums 335 or 336 to the region above the platen 326.

As shown in FIGS. 3, 4, and 6, the first vacuum plenum 335 is fluidically coupled to a printhead group 331 of platen holes 327 and to a control group 332 of platen holes 327. The printhead group 331 comprises platen holes 327 that are located under and adjacent to the printheads 310. The control group 332 is located a predetermined distance upstream of the printhead group 331. The distance between the control group 332 and the printhead group 331 refers to the distance between a downstream edge of the control group 332 and the upstream edge of the printhead group 332. As shown in FIG. 3, and as described in greater detail below with reference to FIGS. 7A-7E, the distance between the printhead and control groups 331 and 332 is such that, for a given size of print medium and a given spacing between print medium, when an inter-media zone 322 is located above the printhead group 331 another inter-media zone is located above the control group 332. In some embodiments, the predetermined distance is equal to the length in the process direction of a given size of print medium, such that when the lead edge LE of the print medium is located at the upstream edge of the printhead group 331 the trail edge TE of the print medium is located at the downstream edge of the control group 332. In some embodiments, the predetermined distance is equal to the length in the process direction of a given size of print medium less a length of the printhead group in the process direction, such that when the lead edge LE of a print medium is located at the downstream edge of the printhead group 331 the trail edge of the print medium is located at the downstream edge of the control group 332, as in FIG. 7D.

The control group 332 may span a distance in the process direction that is approximately equal to or larger than the distance spanned by the printhead group 331 in the process direction. In some embodiments, the length of the control group 332 in the process direction may be equal to that of the printhead group 331. Thus, in such embodiments the positioning of the upstream and downstream inter-media zones 322 relative to the printhead group 331 and the control group 332 is the same—e.g., when trail edge TE of one print medium is at the upstream edge of the printhead group 331, the trail edge TE of the next print medium is also at the upstream edge of the control group 332. Thus, in such embodiments, the number of platen holes 327 in the printhead group 331 that are uncovered by an inter-media zone 322 at any given time will be the same as the number of platen holes 327 in the control group 332 that are uncovered by the other inter-media zone 322.

In other embodiments, the control group 332 may be longer in the process direction than the printhead group 331. This may allow the control group 332 to perform the suction reduction as intended even for multiple sizes of print media (with or without the baffle 350). In addition, providing a longer control group 332 may also help to improve the amount by which the suction is reduced, in some circumstances. Having a longer control group 332 may allow more platen holes 327 to be uncovered in the control group in circumstances where relatively few platen holes are uncovered in the printhead group 331, which can help to reduce the strength of suction even more than would be the case if the same number of platen holes 327 were uncovered in both groups at any given time. This is described in greater detail below with respect to FIGS. 7A-7E, which illustrate one embodiment in which the control group 332 is longer in the process direction than the printhead group 331.

In the embodiment of FIGS. 3-7E, the platen holes 327 that are part of the printhead group 331 and the control group 332 have channel portions 327*b* that extend in the cross-process (x-axis) direction (see FIG. 4), while the remainder of the platen holes 327 have channel portions 327*b* that extend in the process (y-axis) direction (see the expanded cutaway 3A in FIG. 3 and FIG. 4). Having channel portions 327*b* that extend in the cross-process direction can allow the channel portions 327*b* of the printhead and control groups 331 and 332 to be covered and uncovered sequentially as the print media 305 move over the printhead and control groups 331 and 332, which can improve the control of airflow through the control group 332 near the printheads 310 according to the techniques described herein. In other embodiments, the platen holes 327 of the printhead and control groups 331 and 332 may be oriented and arranged similarly to the remainder of the platen holes 327 that are not in the regions of the platen 326 associated with those groups.

As discussed above, in addition to the passively-regulated first vacuum plenum 335 that is configured to communicate the suction force to the printhead group 331 of platen holes 327 and the control group 332 of platen holes, another vacuum plenum, i.e., second vacuum plenum 336, is dedicated to provide suction force to remaining portions of the vacuum platen 326 (i.e., to the remaining group of platen holes not in the printhead group 331 or the control group 332). In the embodiment of FIGS. 3-7E, a second vacuum plenum 336 is thus also provided. The second vacuum plenum 336 provides vacuum suction to all of the platen holes 327 that are not part of the printhead groups 331 and control groups 332. For example, in FIG. 4, all of the illustrated platen holes 327 that have channel portions 327*b* that extend in the process direction are fluidically coupled to the second vacuum plenum 336.

Figure 7A:
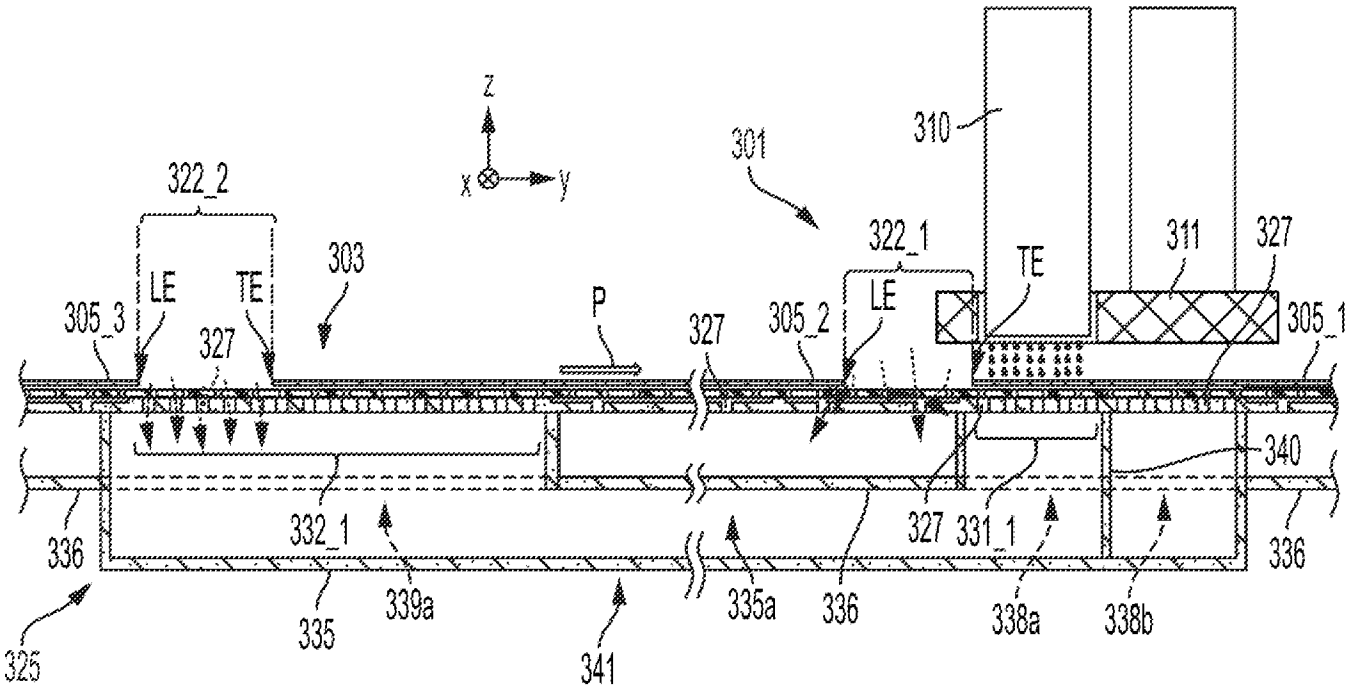
FIGS. 7A-7E are cross-sections of the inkjet printing system of FIG. 3, with the cross-section taken along E in FIG. 4, illustrating different stages of printing on a print medium.

As shown with particular reference to FIGS. 3, 6, and 7A, the second vacuum plenum 336 can be positioned adjacent to the bottom side of the vacuum platen 326 and in a position of partial overlap with the first vacuum plenum 335. The first vacuum plenum 335 can comprise a base portion 341 that is positioned below the second vacuum plenum 336, with part of the second vacuum plenum 336 sandwiched between the base portion 341 of the first vacuum plenum 335 and the vacuum platen 325. In some embodiments, a wall may be shared between the first and second vacuum plenums 335 and 336. With reference again to the embodiment of FIGS. 3-7, a portion of the bottom wall of the second vacuum plenum 336 may be exposed to the interior of the first vacuum plenum 335, in which case that portion of the bottom wall of the second plenum 336 may also be considered as a top wall of the first plenum 335. In other embodiments, the first plenum 335 may have a separate top wall, which is positioned adjacent to a bottom wall of the second plenum 336.

As shown in FIGS. 3-7E (see FIG. 3 in particular), the first vacuum plenum 335 also has an extension duct portion 338 that extends from the base portion 341 up through a hole in the second vacuum plenum 336 to fluidically couple the first plenum 335 to bottom side of the vacuum platen 326 around the printhead group 331 of platen holes 327. Similarly, the first vacuum plenum 335 also has an extension duct portion 339 that extends up from the base portion 341 through another hole in the second vacuum plenum 336 to fluidically couple the first plenum 335 to the bottom side of the vacuum platen 326 around the control group 332 of platen holes 327 (see FIG. 3). The extension duct portions 338 and 339 are fluidically coupled together by the base portion 341 of the first plenum 335 that is positioned below the second plenum 336.

In some embodiments, there may be multiple distinct printhead groups 331 of platen holes 327, which may correspond to different printheads 310 or groups of printheads 310 (e.g., or printhead modules 302). In such examples, multiple control groups 332 may be provided to control airflow through the multiple printhead groups 331, respectively. In addition, the first plenum 335 may be divided into multiple sub-plenums to fluidically couple the printhead groups 331 to the corresponding control groups 332, respectively. A given control group 332 of platen holes 327 may be positioned relative to its corresponding printhead group 332 of platen holes 327 in the same manner as described above, and both may be fluidically coupled to the same sub-plenum. Providing multiple printhead groups 331, control groups 332, and sub-plenums can facilitate the independent control of the airflow around different printheads that may be situated differently. This may be beneficial, for example, when some printheads 310 are located at different positions along the process direction than others. In such circumstances, an inter-media zone will pass under these printheads 310 at different timings, and thus the optimal location of a control group 332 of platen holes 327 may be different for these different printheads 310. Thus, providing separate printhead groups 331 and control groups 332 for these printheads may allow for more accurate control over the airflow at each of these printheads 310.

The embodiment of FIGS. 4-7E illustrates a printing system having passively-regulated plenum divided into two sub-plenums dedicated to two different printhead groups of platen holes. In the embodiment, a first printhead group 331_1 comprises platen holes 327 located under and adjacent to a first printhead 310, and a second printhead group 331_2 comprises platen holes 327 located under and adjacent to the printheads 310_2 and 310_3, which are arranged downstream of the first printhead 310_1. Corresponding control groups 332_1 and 332_2 are provided upstream of the printhead groups 331_1 and 331_2. The control group 332_1 is offset upstream relative to the control group 332_2 by approximately the same distance that the first printhead 310 is offset upstream of the printheads 310_2 and 310_3. The first plenum 335 is divided by a divider wall 340 into two sub-plenums 335*a* and 335*b* (see FIG. 5). The sub-plenum 335*a* includes extension duct portions 338*a* and 339*a*, which are parts of the extension duct portions 338 and 339, respectively, formed by dividing by the extension duct portions 338 and 339 with the divider wall 340. Similarly, the sub plenum 335*b* includes extension duct portions 338*b* and 339*b*, which are formed from the extension duct portions 338 and 339, respectively. In FIGS. 3-7E, the sub-plenum 335*a* is fluidically coupled to the first printhead group 331_1 via the extension portion 338*a* and to the first control group 332_1 via the extension duct portion 339*a*. Furthermore, the sub-plenum 335*b* is fluidically coupled to the second printhead group 331_2 via the extension duct portion 338*b* and to the second control group 332_2 via the extension duct portion 339*b*. Thus, the covering and uncovering of the control group 332_1 of platen holes 327 by print media controls the rate of airflow (and thus suction force) through the printhead group 331_1 of platen holes 327 located under the first printhead 310_1, while the covering and uncovering of the control group 332_2 of platen holes 327 by print media controls the rate of airflow (and thus suction force) through the printhead group 331_2 of platen holes 327 located under the printheads 310_2 and 310_3.

One or more vacuum sources 328 are provided to communicate vacuum suction to the platen holes 327. In some embodiments, separates vacuum sources 328, and 329 are provided for the first plenum 335 and the second plenum 336. In some embodiments in which the first plenum 335 is divided into multiple sub-plenums, separate vacuum sources 328 (only one is illustrated) are also provided for the various sub-plenum. For example, in the embodiment of FIGS. 3-7E, three vacuum sources 328 are provided to communicate vacuum suction to the second plenum 336, the sub-plenum 335*a*, and the sub-plenum 335*b*, respectively. In the illustrated embodiment, the vacuum sources 328 are positioned at (e.g., above, below, or in) a bottom wall of the first plenum 335 and are configured to pull air through holes in the bottom wall of the first plenum 335 and expel the air into a return passage (not illustrated). The specific location and configuration of the vacuum sources 328 is not limited. As shown in FIGS. 3-6 (see FIG. 3 in particular), a conduit 337 extends down from the second plenum 336 through the interior of the first plenum 335 to fluidically couple the second plenum 325 with one of these vacuum sources 328. The other two vacuum sources 328 (in FIG. 3, one of these vacuum sources 328 is obscured) are fluidically coupled with the sub-plenums 335*a* and 335*b*, with the divider 340 passing between the vacuum sources 328.

In the embodiment of FIGS. 4-7E, the printheads 310_2 and 310_3 are aligned in the cross-process direction, and therefore an inter-media zone reaches both of these printheads 310 at the same timing. Thus, a single printhead group 331_2 and corresponding control group 332_2 can be provided to control airflow around both of these printheads 310. However, in some embodiments, separate printhead groups 331 (and corresponding control groups 322 and sub-plenums) can be provided for printheads 310 even if they are aligned in the cross-process direction. Moreover, in some embodiments two or more printheads 310 can share the same printhead group 331 (and corresponding control group 332 and sub-plenum) even if some of the printheads 310 are located at different positions along the process direction.

In the embodiment of FIGS. 4-7E, the various printhead groups 331 and control groups 332 are coupled together by corresponding sub-plenums formed by dividing the first plenum 335 into parts. In other embodiments, rather than dividing the first plenum 355 into sub-plenums, completely separate first plenums 335 may be provided for each pair of printhead group 331 and control group 332.

In some embodiments, the vacuum assembly 325 comprises a baffle 350 (see FIGS. 5 and 6). The baffle 350 is positioned between the vacuum platen 326 and the extension duct portion 338 of the first plenum 335, such that the baffle 350 can block airflow through some of the platen holes 327 in the controls group(s) 332. In the embodiment illustrated in FIG. 6, the baffle 350 comprises one or more apertures 351, such that airflow is allowed through those platen holes 327 of the control group(s) 332 that happen to be located above one of the apertures 351. The baffle 350 is movable in the process direction, thus allowing the location of the holes 327 through which airflow is allowed to be changed. Thus, the baffle 350 allows, in effect, the location of the control group 332 to be changed. More specifically, the location of the control group 332 as a whole does not change, but the portion of the control group 332 through which airflow is allowed changes. In some embodiments, the baffle 350 is moved to a position based on the size of the print media being used in a print job. This is done to ensure that the control group 332 (or the portion thereof through which airflow is allowed) is properly positioned relative to the printhead group 331 despite variation in the size of print media that might be used in a printing system. As described above, the proper positioning of the control group 332 relative to the printhead group 331 is a positioning in which, when an inter-media zone is located above the printhead group 331, another inter-media zone is also located above the control group 332. But the distance between inter-media zones depends on the size of the print media, and therefore if the control group 332 is positioned with one print medium in mind, then when another print medium is used the control group 332 may not be at a desired position. However, by moving the baffle 350 the effective location of the control group 332 can be changed such that the desired relative position is maintained despite the change in size in print media. In some embodiment, the baffle 350 may be omitted. In some embodiments, the baffle 350 may lack apertures, and may act as a shutter that blocks airflow through platen holes 327 located above the baffle 350 while allowing airflow through platen holes 327 not located above the baffle 350.

As described above, the relative positioning of the control group(s) 332 and printhead groups 331 allows for reduction in the rate of airflow around the printheads 310 as two inter-media zones simultaneously pass over the control and printhead groups 332, 331 of platen holes 327, thus reducing crossflows that tend to cause blur during a printing operation. Moreover, this reduction in the rate of airflow occurs automatically when the inter-media zone passes under the printheads 310, with the change being controlled passively by the movement of the print media over the control group(s) 332. These phenomena are described in greater detail below with reference to FIGS. 7A-7E.

FIG. 7A illustrates a state in which an inter-media zone 322_1 is about to move over a printhead group 331_1, which is associated with the first printhead 310_1, i.e., the trail edge TE of the print media 305_1 is located at the upstream edge of the printhead group 331_1. In this state, a subsequent inter-media zone 322_2 (i.e., upstream of the inter-media zone 322_1) is positioned above the control group 332_1, and thus some of the platen holes 327 in the control group 332_1 are uncovered. Because platen holes 327 in the control group 332_1 are uncovered, the pressure in the first sub-plenum 335*a* is raised (as compared to if the platen holes were covered), which results in reducing the strength of suction at the printhead group 331_1. Immediately after the timing illustrated in FIG. 7A, platen holes 327 in the printhead group 331_1 will start to become uncovered as the inter-media zone 322_1 continues to move downstream and this would tend to induce airflows, which may include some crossflows, through the newly uncovered platen holes 327 in the printhead group 331_1. However, because the strength of suction in the first sub-plenum 335*a* is already reduced (because the platen holes 327 of the control group 332_1 are uncovered), as these platen holes 327 in the printhead group 331_1 become uncovered the airflow through the newly uncovered platen holes 327 is relatively weaker than it otherwise would have been. Thus, the strength of the crossflows is reduced.

Figure 7B:
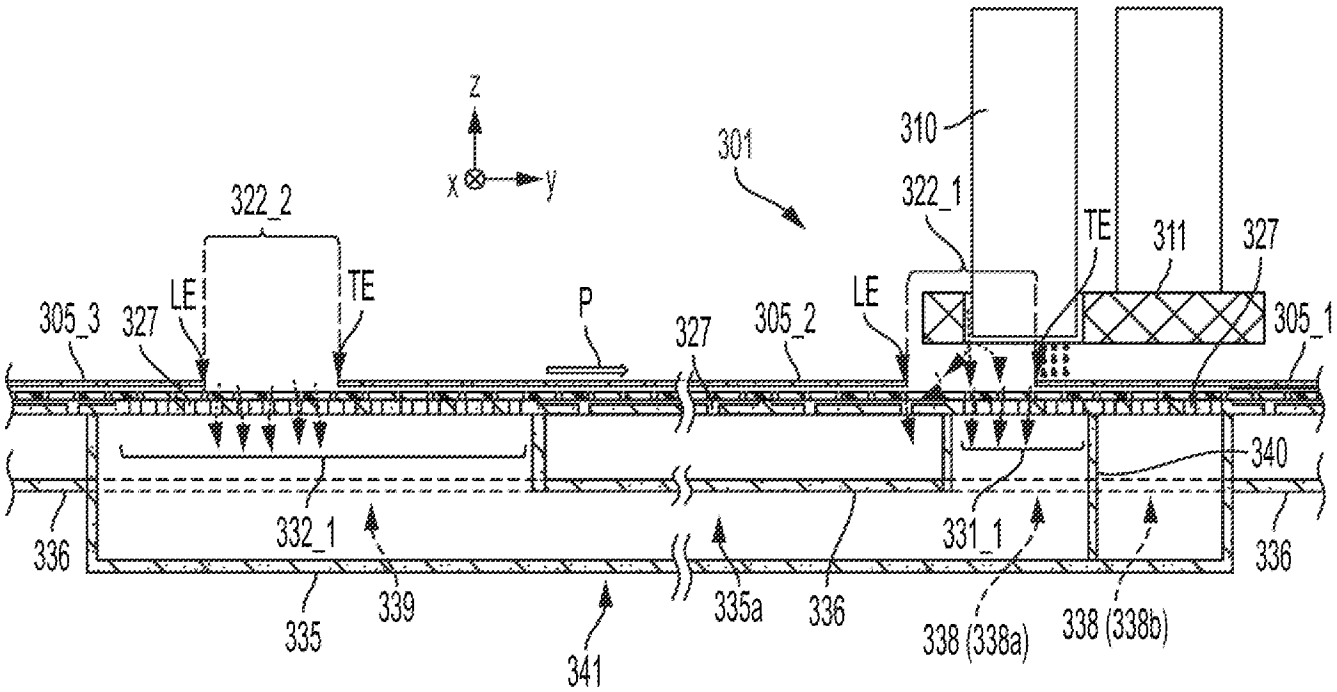

As the inter-media zone 322_1 continues to move downstream and more platen holes 327 in the printhead group 331_1 become uncovered, the inter-media zone 322_2 also moves downstream, as illustrated in FIG. 7B. In the illustrated embodiment, the control group 332_1 is configured such that the inter-media zone 322_2 continues to remain above a portion of the control group 332_1 as long as the inter-media zone 322 is above the printhead group 331_1. Thus, despite the movement of the inter-media zone 322_2 downstream, platen holes 327 in the control group 332_1 remain uncovered in the state illustrated in FIG. 7B, and therefore the strength of suction through the printhead group 331_1 remains relatively lower than it otherwise would have been. The state illustrated in FIG. 7B is similar to the state illustrated in FIG. 1A, and in this state crossflows tend to be induced which can create image blur near the trail edge TE of the print medium 305_1, as described above with respect to FIG. 1A. However, because the strength of suction through the printhead group 331_1 is relatively lower in the embodiment, the strength of the crossflows is reduced and therefore the amount of image blur is reduced.

Figure 7C:
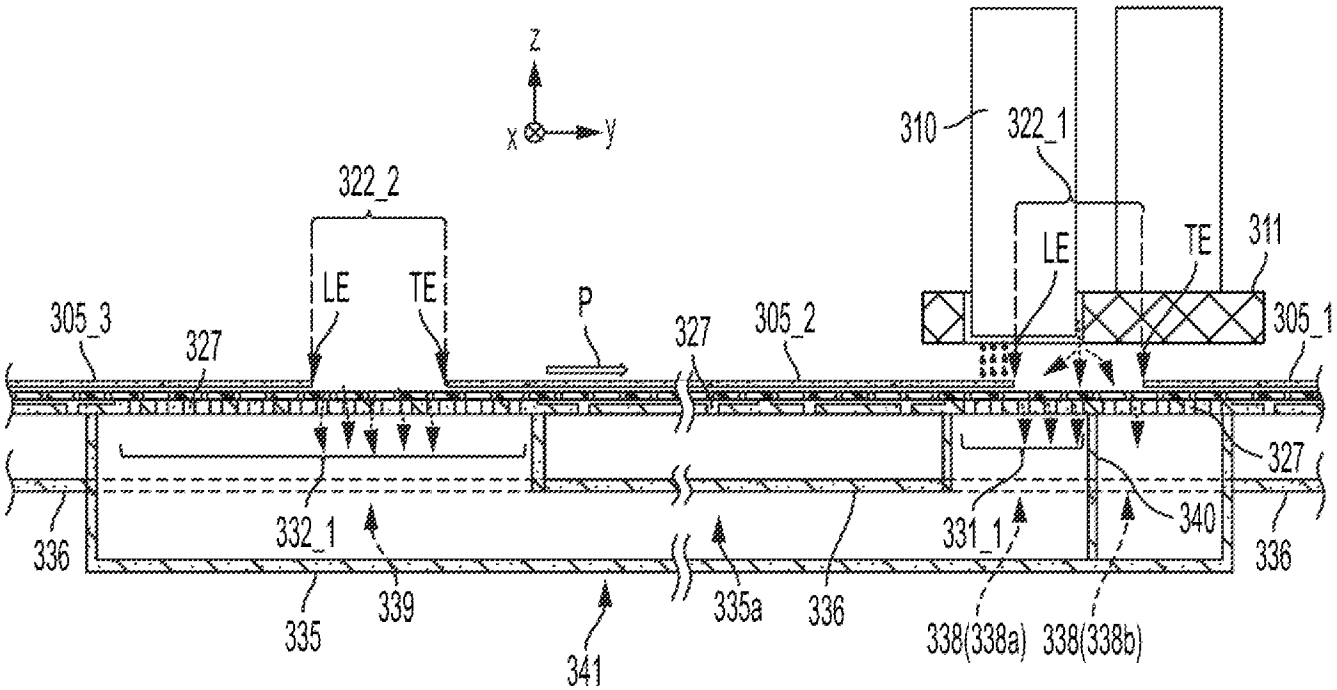
Figure 7D:
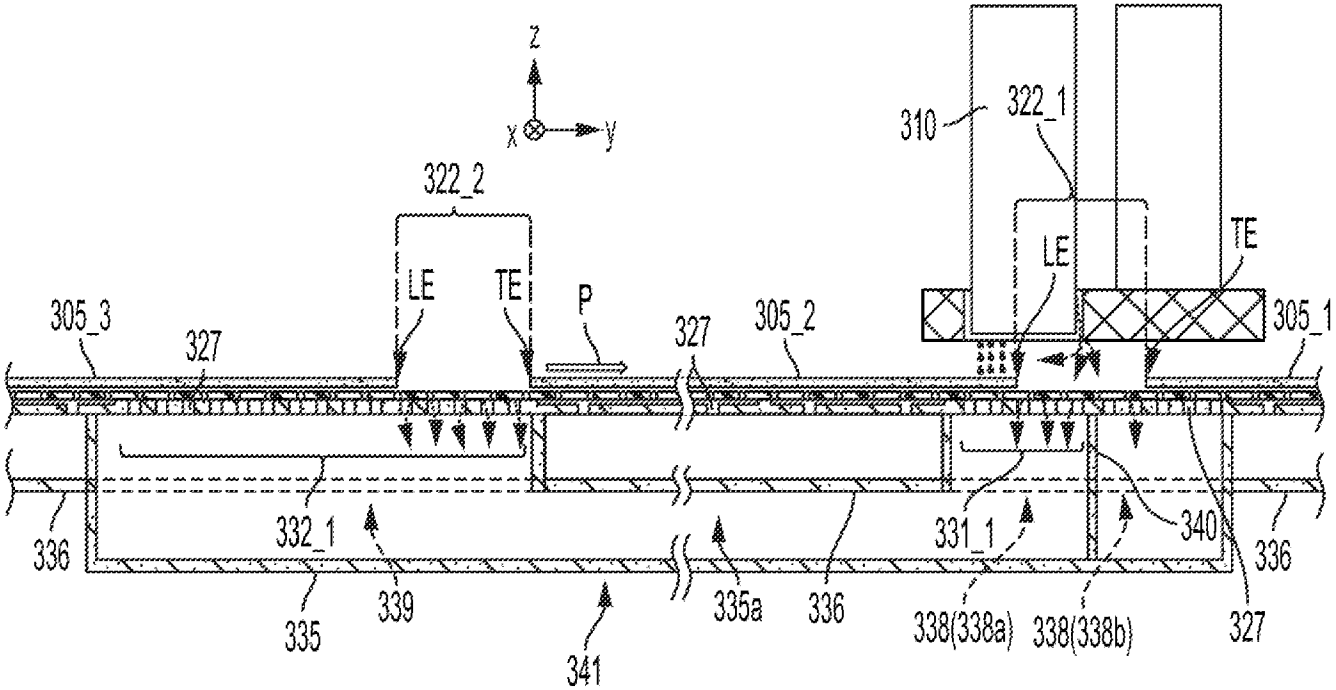

FIG. 7C illustrates a state in which the inter-media zone 322_1 has advanced further downstream such that the print medium 305_2 (located in the consecutive upstream position relative to the print medium 305_1) is now entering the deposition region of the printheads 310 and being printed on near the lead edge LE thereof. This state is similar to the state illustrated in FIG. 1B, and in such a state crossflows are likely to be induced which can cause image blur near the lead edge LE, as described above with respect to FIG. 1B. However, because platen holes 327 of the control group 332_1 continue to be uncovered (i.e., the inter-media zone 322_2 is still located above the control group 332_1), the strength of suction through the first sub-plenum continues to be relatively weak and thus the amount of image blur is reduced as explained above.

Figure 7E:
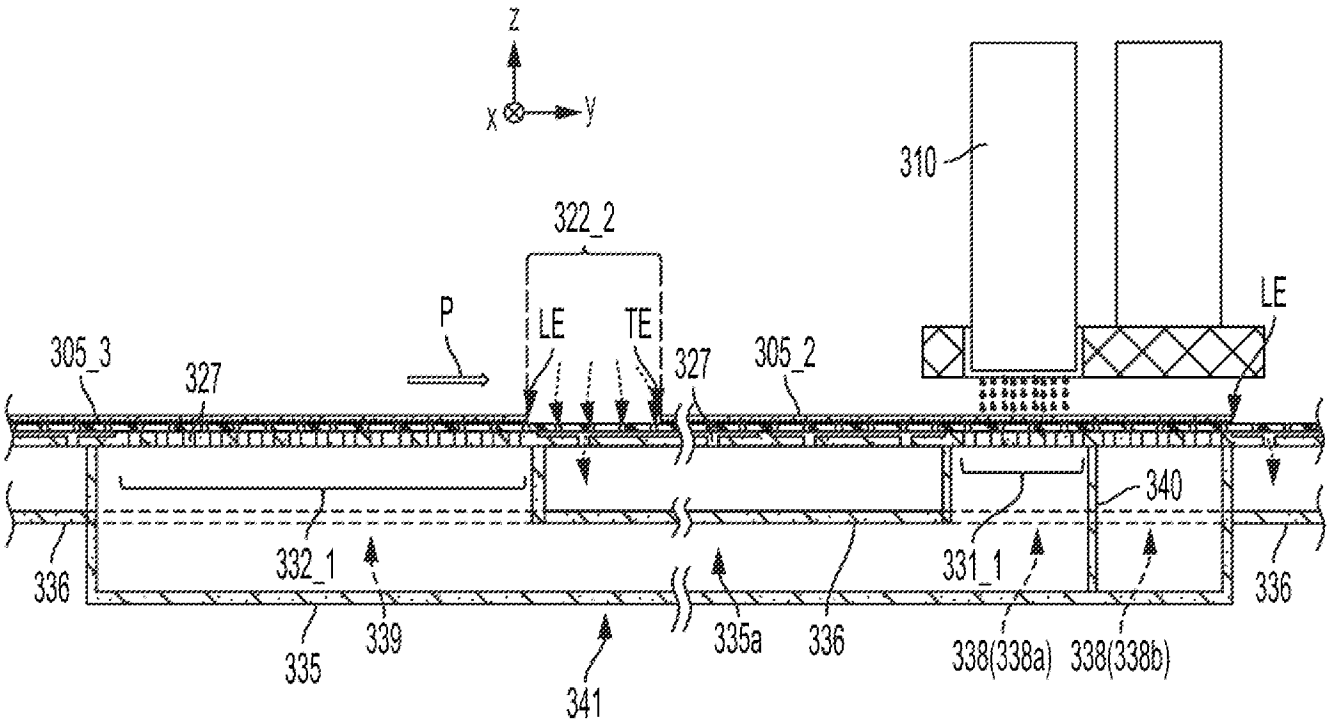

In the illustrated embodiment, the inter-media zone 322_2 continues to remain over the control group 332_1 until the inter-media zone 322_1 is no longer located over the printhead group 331_1. In the state illustrated in FIG. 7D, the inter-media 322_1 has just moved past the printhead group 331_1 (i.e., the lead edge LE is at the downstream boundary of the printhead group 331_1), and the platen holes 327 of the printhead group 331_1 are fully covered. In this state, the reduced suction caused by the control group 332_1 is no longer needed to mitigate image blur, and therefore there is no longer any need for the control group 332_1 to be uncovered. Thus, the control group 332_1 is arranged such that, after the timing illustrated in FIG. 7D, the inter-media zone 322_2 will begin to move away from the control group 332_1 such that fewer and fewer platen holes 327 are uncovered in the control group 332_1. As fewer platen holes 327 in the control group 332_1 remain uncovered (i.e., as more become covered by the print medium 305_3), the pressure in the first sub-plenum 335*a* will start to decrease (with corresponding suction increasing). Eventually the entire control group 332_1 is fully covered by the print medium 305_3, as illustrated in FIG. 7E, and in this state the pressure in the sub-plenum 335*a* reaches its lowest level. Thus, relatively strong hold down force can be applied to the print media 305_2 and 305_3 via the platen holes 327 in the control group 332_1 and the printhead group 331_1. Accordingly, the illustrated embodiment beneficially provides for relatively weaker airflow through the printhead group 331_1 during the timings when crossflows are most likely (i.e., while the inter-media zone is moving under the printhead 310, thus reducing image blur, while still allowing for relatively strong hold down force to be applied to the print media the remainder of the time.

Operation of the control group 332_2 and the printhead group 331_2 is similar to that of the control group 332_1 and printhead group 331_1, except that the control group 332_2 and the printhead group 331_2 are both offset downstream relative to the control group 332_1 and printhead group 331_1.

In the embodiment illustrated in FIG. 3-7E, the control group 332_1 is longer in the process direction than the printhead group 331_1. In other words, the control group 332_1 contains more rows of platen holes 327 than the printhead group 331_1. In particular, the control group 332_1 is arranged such that the entire length of the inter-media zone 322_2 (in the process direction) is already located above the control group 332_1 when the printhead group 311_1 begins to be uncovered by the inter-media zone 322_1 (see FIG. 7A), and the entire length of the inter-media zone 322_2 remains above the control group 332_1 for as long as any portion of the printhead group 331_1 is uncovered by the inter-media zone 322_1 (i.e., see FIGS. 7B-7D). This ensures that a full complement of platen holes 327 from the control group 332_1 (i.e., a number of platen holes 327 corresponding to the full length of an inter-media zone 322) remains uncovered whenever any portion of the printhead group 331_1 is uncovered. The amount by which the control group 332_1 is able to reduce the strength of suction in the first sub-plenum 335*a* is related to the number of platen holes 327 in the control group 332_1 that are uncovered—the more uncovered holes 327, the greater the reduction in the strength of suction, or in other words the higher the pressure in the sub-plenum. Thus, by ensuring that a full complement of platen holes 327 of the control group 332_1 are uncovered whenever any part of the printhead group 331_1 is uncovered, the control group 332_1 is able to reduce the strength of suction in the first sub-plenum 335*a* to the fullest extent possible during this sensitive time period. This ensures that any crossflows that happen to be induced through the printhead group 331_1 are reduced in strength.

In contrast, if the control group 332_1 were shorter in the process direction (i.e., contained fewer rows of platen holes 327), then at certain timings only a part of the inter-media zone 322_2 will be located above the control group 332_1 while platen holes 327 of the printhead group 331_1 are uncovered. Thus, at some points in time, relatively fewer platen holes 327 in the control group 332_1 are uncovered, and thus the ability of the control group 332_1 to reduce the strength of suction in the sub-plenum 335*a* will be somewhat inhibited.

For example, if the control group 332_1 and printhead group 331_1 are the same length in the process direction, then as noted above the number of rows of platen holes 327 in the control group 332_1 that are uncovered at any given time may be the same as the number of rows of platen holes 327 in the printhead group 331_1 that are uncovered. Thus, when just one row of platen holes 327 is uncovered in the printhead group 331_1, just one row of platen holes 327 in the control group 332_1 will be uncovered. With only one uncovered row of platen holes 327 in the control group 332_1 contributing to the reduction in the strength of airflow through the printhead group 331_1, the airflow through the uncovered row of platen holes 327 in the printhead group 331_1 will be relatively strong. The one uncovered row of platen holes 327 in the control group 332_1 will still reduce the strength of airflow through the uncovered hole 327 in the printhead group 331_1 somewhat (as compared to if there were no control group 332_1 at all), but the amount by which the airflow is reduced will be much lower than it would be if more platen holes 327 in the control group 332_2 were uncovered. In contrast, at the same timing in the embodiment of FIGS. 7A-7E in which only one row of platen holes 327 is uncovered in the printhead group 331, the full number of rows corresponding to the inter-media zone 322_2 is uncovered in the control group 322, thus providing greater reduction in suction strength.

Although arranging the control groups 332 to be relatively longer then the corresponding printhead groups 331 in the process direction, as in the embodiment of FIGS. 3-7E, may have some advantages in some circumstances, in some embodiments the control groups 332 are arranged differently. In some embodiments, the control groups 332 are relatively longer than their corresponding printhead groups 331 in the process direction, but not necessarily long enough to ensure that the full complement of platen holes 327 in the control group 332 is always uncovered whenever any part of the corresponding printhead group 331 is uncovered. In some embodiments, the control groups 332 are the same length as their corresponding printhead groups 331 in the process direction.

In the discussion above related to the length of the control groups 332 in the process direction, the presence of a baffle 350 was omitted to simplify the discussion. In embodiments in which a baffle 350 is included, the descriptions above referring to the length of the control group 332 in a process direction would instead refer to the length of the aperture 351 in the process direction. To allow for a range of movement of the baffle 350, the length of the entire control group 332 in the process direction may need to be even larger.

In some embodiments, the baffle 350 is omitted. In particular, in some embodiments the control group 332 is relatively long in the process direction, and this length of the control group 332 may provide sufficient leeway to accommodate different sizes of print media without needing the baffle 350 to reposition the effective control group 332. In some embodiments, the control group 332 is sized based on a particular size of print media such that the full complement of platen holes 327 in the control group 332 is uncovered whenever any part of the printhead group 331 is uncovered, as described above. In such an embodiment, if a smaller or larger print medium is used, the control group 332 will still be able to reduce the suction for the printhead group 331 when the inter-media zone is above the printhead group 331 as described above, with the exception that for some periods of time less than a full complement of platen holes 327 in the control group 332 will be uncovered. Thus, the effectiveness of the control group 332 in reducing the airflow may be inhibited slightly when smaller or larger print media are used, but the control group 332 will still be able to reduce the airflow at least somewhat.

FIGS. 3-7E illustrate an example of how the platen holes, control group(s), printhead group(s), first plenum(s), and second plenum described herein may be provided. However, these examples are not limiting. In particular, any desired shape or configuration of platen holes may be used. Moreover, any arrangement of control group and printhead group may be used, as long as they are coupled to the same first plenum, which is separate from the plenum that supplies other platen holes, and arranged such that an inter-media zone is located above the control group when an inter-media zone is above the printhead group. Furthermore, any shape or arrangement of first plenum and second plenum can be used, as long as the first plenum is fluidically coupled to the control group and printhead group while the second plenum is fluidically coupled to the remaining platen holes.

Figure 8:
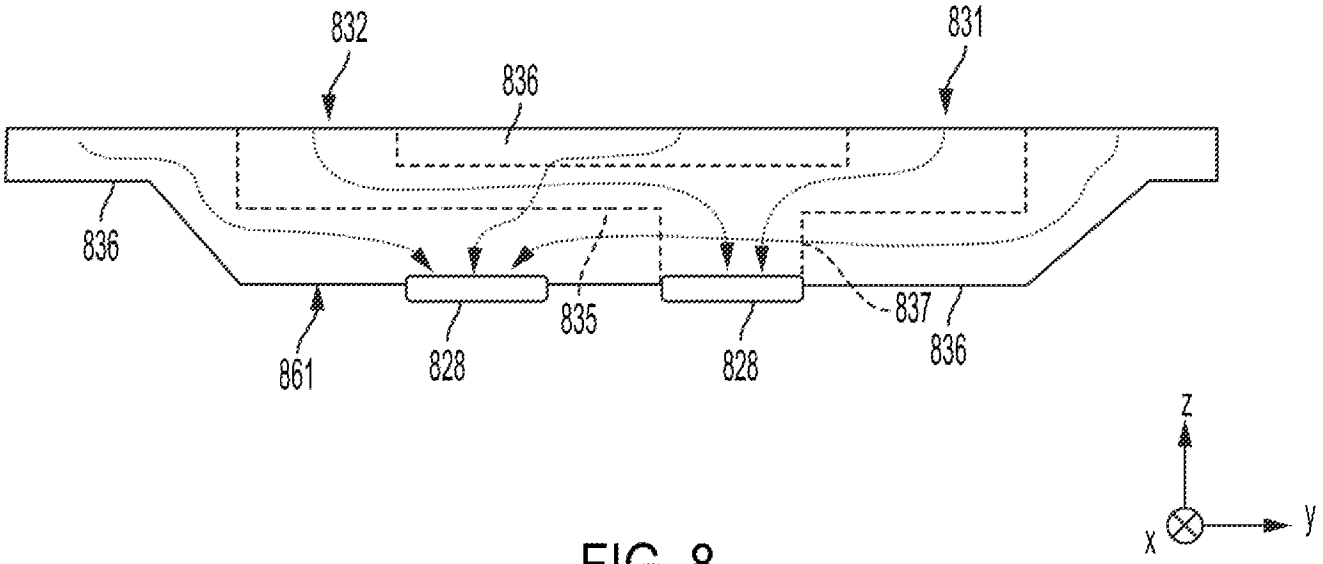
FIG. 8 is a schematic illustration of vacuum assembly of an embodiment of an inkjet printing system.

For example, FIG. 8 illustrates an embodiment in which the first plenum 835 is contained entirely within the second plenum 836, with the vacuum sources 826 being coupled to a bottom wall of the second plenum 836 and the first plenum 835 being coupled to a vacuum source 828 via a conduit 837. As with the other embodiments described herein, in this embodiment the first plenum 835 is coupled to a printhead group 831 of platen holes and a control group 832 of platen holes. Furthermore, although specific configurations of various components are illustrated in the figures and described in detail above to provide context and aid understanding, it should be understood that embodiments disclosed herein encompass a variety of printing systems having components that can be configured differently than the illustrated examples, such as differently configured printhead modules, printheads, vacuum plenums, vacuum platens, platen holes, and/or movable support surfaces. In particular, the techniques disclosed herein can be used in a variety of printing systems regardless of the specific configurations of the printhead modules, printheads, vacuum plenums, vacuum platens, platen holes, and/or movable support surfaces.

This description and the accompanying drawings that illustrate inventive aspects and embodiments should not be taken as limiting—the claims define the protected invention. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

Further, the terminology used herein to describe aspects of the invention, such as spatial and relational terms, is chosen to aid the reader in understanding embodiments of the invention but is not intended to limit the invention. For example, spatial terms—such as "beneath", "below", "lower", "above", "upper", "inboard", "outboard", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The term "process direction" refers to a direction that is parallel to and pointed in the same direction as an axis along which the print media moves as it is transported through the deposition region of the ink deposition assembly. Thus, the process direction is a direction parallel to the y-axis in the Figures and pointing in a positive y-axis direction.

The term "cross-process direction" refers to a direction perpendicular to the process direction and parallel to the movable support surface. At any given point, there are two cross-process directions pointing in opposite directions, i.e., an "inboard" cross-process direction and an "outboard" cross-process direction. Thus, considering the reference frames illustrated in the Figures, a cross-process direction is any direction parallel to the x-axis, including directions pointing in a positive or negative direction along the x-axis. References herein to a "cross-process direction" should be understood as referring generally to any of the cross-process directions, rather than to one specific cross-process direction, unless indicated otherwise by the context. Thus, for example, the statement "the valve is movable in a cross-process direction" means that the valve can move in an inboard direction, outboard direction, or both directions.

The terms "upstream" and "downstream" may refer to directions parallel to a process direction, with "downstream" referring to a direction pointing in the same direction as the process direction (i.e., the direction the print media are transported through the ink deposition assembly) and "upstream" referring to a direction pointing opposite the process direction. In the Figures, "upstream" corresponds to a negative y-axis direction, while "downstream" corresponds to a positive y-axis direction. The terms "upstream" and "downstream" may also be used to refer to a relative location of element, with an "upstream" element being displaced in an upstream direction relative to a reference point and a "downstream" element being displaced in a downstream direction relative to a reference point. In other words, an "upstream" element is closer to the beginning of the path the print media takes as it is transported through the ink deposition assembly (e.g., the location where the print media joins the movable support surface) than is some other reference element. Conversely, a "downstream" element is closer to the end of the path (e.g., the location where the print media leaves the support surface) than is some other reference element. The reference point or the other element to which the "upstream" or "downstream" element is compared may be explicitly stated (e.g., "an upstream side of a printhead"), or it may be inferred from the context.

The terms "inboard" and "outboard" refer to cross-process directions, with "inboard" referring to one to cross-process direction and "outboard" referring to a cross-process direction opposite to "inboard." In the Figures, "inboard" corresponds to a positive x-axis direction, while "outboard" corresponds to a negative x-axis direction. The terms "inboard" and "outboard" also refer to relative locations, with an "inboard" element being displaced in an inboard direction relative to a reference point and with an "outboard" element being displaced in an outboard direction relative to a reference point. The reference point may be explicitly stated (e.g., "an inboard side of a printhead"), or it may be inferred from the context.

The term "vertical" refers to a direction perpendicular to the movable support surface in the deposition region. At any given point, there are two vertical directions pointing in opposite directions, i.e., an "upward" direction and an "downward" direction. Thus, considering the reference frames illustrated in the Figures, a vertical direction is any direction parallel to the z-axis, including directions pointing in a positive z-axis direction ("up") or negative z-axis direction ("down").

The term "horizontal" refers to a direction parallel to the movable support surface in the deposition region (or tangent to the movable support surface in the deposition region, if the movable support surface is not flat in the deposition region). Horizontal directions include the process direction and cross-process directions.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference pressure, such as ambient or atmospheric pressure. The amount by which the pressure of the vacuum environment should be lower than that of the reference pressure to be considered a "vacuum" is not limited and may be a small amount or a large amount. Thus, "vacuum" as used herein may include, but is not limited to, states that might be considered a "vacuum" under stricter senses of the term.

The term "air" has various meanings in various contexts, ranging from a strict meaning of the atmosphere of the Earth (or a mixture of gases whose composition is similar to that of the atmosphere of the Earth), to a more generic meaning of any gas or mixture of gases. Herein, the term "air" is used in the generic sense, and should be understood as referring broadly to any gas or mixture of gases. This may include, but is not limited to, the atmosphere of the Earth, an inert gas such as one of the Noble gases (e.g., Helium, Neon, Argon, etc.), Nitrogen ($N_2$) gas, or any other desired gas or mixture of gases.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically directly coupled, or they may be indirectly coupled via one or more inter-mediate components, unless specifically noted otherwise. Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

It is to be understood that the particular examples and embodiments set forth herein are non-limiting, and modifications to structure, dimensions, materials, and methodologies may be made without departing from the scope of the present teachings.

Other embodiments in accordance with the present disclosure will be apparent to those skilled in the art from consideration of the specification and practice of the inventions disclosed herein. It is intended that the specification and embodiments be considered as exemplary only, with the following claims being entitled to their fullest breadth, including equivalents, under the applicable law.

What is claimed is:

1. A printing system, comprising:

an ink deposition assembly comprising a printhead arranged to eject a print fluid to a deposition region of the ink deposition assembly;

a media transport assembly comprising:

a vacuum assembly comprising:

a vacuum platen comprising a plurality of platen holes;

a first vacuum source and a first vacuum plenum fluidically coupled to the first vacuum source, and a second vacuum source and a second vacuum plenum fluidically coupled to the second vacuum source, and a movable support surface, wherein the media transport assembly is configured to:

hold a print medium against the movable support surface by vacuum suction communicated from the first and second vacuum sources to the movable support surface via the first and second vacuum plenums and the platen holes, and transport the print medium in a process direction through the deposition region, wherein the first vacuum plenum is fluidically coupled to a first group of the platen holes and to a second group of the platen holes, the first group of platen holes being located at least partially in the deposition region and the second group of platen holes being located upstream, relative to the process direction, of the first group; and wherein the second vacuum plenum is fluidically coupled to a third group of the platen holes, the third group comprising at least some platen holes located between the first and second groups of platen holes.

2. The printing system of claim 1, wherein the second group is positioned relative to the first group such that, for a given size of print media that the printing system is configured to use, on condition of a first inter-media zone between a first pair of adjacent print media being transported on the movable support surface being located above the first group, a second inter-media zone between a second pair of adjacent print media being transported on the movable support surface is located above the second group.

3. The printing system of claim 2, wherein the second group is positioned relative to the first group such that, for the given size of print media, whenever any part of the first inter-media zone is located above any of the platen holes of the first group, at least part of the second inter-media zone is located above at least part of the second group.

4. The printing system of claim 3, wherein the second group is positioned relative to the first group such that, for the given size of print media, whenever any part of the first inter-media zone is located above any of the platen holes of the first group, a full length of the second inter-media zone in the process direction is located above the second group.

5. The printing system of claim 1, wherein the vacuum assembly further comprises a baffle positioned between the vacuum platen and the first vacuum plenum below the second group, the baffle configured to cover and uncover holes in the second group.

6. The printing system of claim 5, wherein the baffle comprises an aperture and is movable in the process direction.

7. The printing system of claim 5, further comprising:

a control system configured to position the baffle based on a size of print media selected for a print job.

8. The printing system of claim 1, wherein the vacuum assembly is configured to adjust at least one of a number, a location, or a number and a location of active platen holes in the second group, the active platen holes being platen holes of the second group through which vacuum suction is permitted.

9. The printing system of claim 1, wherein platen holes comprise channel portions;

wherein the respective channel portions of the platen holes in the third group extend in the process direction; and wherein the respective channel portions of the platen holes in the first and second groups extend in a cross-process direction.

10. The printing system of claim 1, wherein the ink deposition assembly comprises a second printhead, wherein the vacuum assembly comprises a third vacuum source and a third vacuum plenum fluidically coupled to the third vacuum source;

wherein the third vacuum plenum is fluidically coupled to a fourth group of the platen holes and a fifth group of the platen holes;

wherein the fourth group is located at least partially under the second printhead and the fifth group is located upstream of the fourth group.

11. The printing system of claim 10, wherein the first vacuum plenum and the third vacuum plenum are sub-plenums of a larger vacuum plenum, a divider wall separating the larger vacuum plenum into the first vacuum plenum and the third vacuum plenum.

12. The printing system of claim 1, wherein at least a portion of the second vacuum plenum is located between the first vacuum plenum and the vacuum platen; and the first vacuum plenum comprises extension duct portions that extend through the second vacuum plenum to fluidically couple the first vacuum plenum to the first and second groups of the platen holes.

13. The printing system of claim 1, wherein the movable support surface comprises a belt configured to move over a surface of the vacuum platen, the belt comprising belt holes through which the vacuum suction is communicated to the print medium.

14. The printing system of claim 1, wherein the second group of the platen holes is arranged relative to the first group of the platen holes such that interaction between print media transported by the movable support surface and inter-media zones between the print media on the movable support surface with the first and second groups of platen holes passively controls a rate of airflow through the first and second groups of platen holes.

15. A method, comprising:

loading print media onto a movable support surface of a media transport assembly of a printing system;

communicating vacuum suction through a first vacuum plenum to a first group of platen holes of a vacuum platen of the media transport assembly and to a second group of platen holes of the vacuum platen, the first group being located at least in part under a printhead of the printing system and the second group being located upstream of the first group;

communicating vacuum suction through a second vacuum plenum to a third group of platen holes of the vacuum platen, the third group being located at least in part between the first and second groups;

holding the print media against the movable support surface via the vacuum suction;

transporting the print media in a process direction through a deposition region of a printhead of the printing system by moving the movable support surface relative to the vacuum platen; and ejecting print fluid from the printhead to deposit the print fluid to the print media in the deposition region.

16. The method of claim 15, wherein the method further comprises reducing a rate of airflow through the first group of platen holes while at least a portion of the first group of platen holes is not covered by any of the print media by causing at least a portion of the second group of platen holes to not be covered by any of the print media.

17. The method of claim 16, wherein causing the portion of the second group of platen holes to not be covered by any of the print media while the portion of the first group of platen holes is not covered by any of the print media comprises positioning an inter-media zone between a pair of adjacent print media over the second group of platen holes while another inter-media zone between another pair of adjacent print media is positioned over the first group of platen holes.

18. The method of claim 15, wherein the method further comprises positioning a baffle of the printing system along the process direction based on a size of the print media, the baffle comprising an aperture and being located between the first vacuum plenum and the vacuum platen below the second group of platen holes.

* * * * *